US012662347B2

(12) United States Patent
Tsunoda et al.

(10) Patent No.: US 12,662,347 B2
(45) Date of Patent: Jun. 23, 2026

(54) TRANSFER APPARATUS

(71) Applicant: DUPLO CORPORATION, Sagamihara (JP)

(72) Inventors: Kazutaka Tsunoda, Sagamihara (JP); Yukitaka Higuchi, Sagamihara (JP); Shuhei Yamamoto, Sagamihara (JP)

(73) Assignee: DUPLO CORPORATION, Kanagawa (JP)

( * ) Notice: Subject to any disclaimer, the term of this patent is extended or adjusted under 35 U.S.C. 154(b) by 118 days.

(21) Appl. No.: 18/425,300

(22) Filed: Jan. 29, 2024

(65) Prior Publication Data

US 2024/0166464 A1 May 23, 2024

Related U.S. Application Data

(63) Continuation of application No. PCT/JP2022/028859, filed on Jul. 27, 2022.

(30) Foreign Application Priority Data

Jul. 30, 2021 (JP) ..... 2021-126031

(51) Int. Cl.
*B65H 37/00* (2006.01)
*B65H 23/02* (2006.01)
*B65H 27/00* (2006.01)

(52) U.S. Cl.
CPC ..... *B65H 37/002* (2013.01); *B65H 23/0216* (2013.01); *B65H 27/00* (2013.01)

(58) Field of Classification Search
CPC ..... B41F 13/56; B41F 13/64; B41F 13/68; B41F 16/0013; B41F 16/0026;
(Continued)

(56) References Cited

U.S. PATENT DOCUMENTS

2009/0000745 A1 1/2009 Hirokawa et al.
2011/0290139 A1 12/2011 Puschel et al.
(Continued)

FOREIGN PATENT DOCUMENTS

EP 1556222 B1 12/2010
JP 4-242276 A 8/1992
(Continued)

OTHER PUBLICATIONS

International Search Report dated Sep. 20, 2022, issued in counterpart International Application No. PCT/JP2022/028859. (3 pages).
(Continued)

*Primary Examiner* — Sonya M Sengupta
(74) *Attorney, Agent, or Firm* — WHDA, LLP

(57) ABSTRACT

A transfer apparatus transfers a transfer substance or a surface shape of a transfer web in a transfer section from the transfer web that is carried along a web route to a transfer target object that is carried along a carrying surface. The transfer apparatus includes a gap adjustment mechanism that adjusts the size of a gap between the carrying surface and the web route in the transfer section, and a controller that controls the gap adjustment mechanism to adjust the size of the gap to be a size corresponding to the thickness of the transfer target object.

19 Claims, 12 Drawing Sheets

(58) Field of Classification Search
CPC .... B41F 16/006; B41F 19/001; B41F 19/004; B41F 23/00; B41F 23/044; B41F 23/0453; B41F 23/08; B41F 33/0081; B41F 33/14; B41F 33/16; B41P 2233/20; B65H 23/0216; B65H 27/00; B65H 37/002
See application file for complete search history.

(56) References Cited

U.S. PATENT DOCUMENTS

| | | | | |
|---|---|---|---|---|
| 2014/0305577 | A1 | 10/2014 | Barth | |
| 2015/0346651 | A1 | 12/2015 | Nagata et al. | |
| 2018/0257369 | A1 | 9/2018 | Takeuchi | |
| 2024/0166464 | A1 * | 5/2024 | Tsunoda | B41F 19/001 |

FOREIGN PATENT DOCUMENTS

| | | | |
|---|---|---|---|
| JP | 2009-29110 | A | 2/2009 |
| JP | 2009-186589 | A | 8/2009 |
| JP | 2011-222774 | A | 11/2011 |
| JP | 2012-513321 | A | 6/2012 |
| JP | 2015-225172 | A | 12/2015 |
| JP | 2016-114649 | A | 6/2016 |
| JP | 2018-144435 | A | 9/2018 |
| JP | 2021-91197 | A | 6/2021 |
| WO | 2010/072538 | A1 | 7/2010 |

OTHER PUBLICATIONS

Extended (supplementary) European Search Report dated Jul. 8, 2025, issued in counterpart EP Application No. 22849517.2. (12 pages).

* cited by examiner

TRANSFER APPARATUS

TECHNICAL FIELD

The present invention relates to a transfer apparatus.

BACKGROUND ART

There is a known transfer apparatus that transfers a transfer substance, such as foil, to a transfer target object, such as a sheet, from a transfer web carried by a roll-to-roll method. There is also a known transfer apparatus that performs processing, which is called lamination coating processing or the like, in which a curable coat layer applied to a surface of a transfer target object and a transfer web are brought into close contact with each other, a surface shape formed by irregularities of a surface of the transfer web is transferred to the coat layer, and the surface shape of the transfer web is thereby transferred with respect to the transfer target object.

CITATION LIST

Patent Literature

PTL 1: Japanese Unexamined Patent Application Publication No. 2021-091197

SUMMARY OF INVENTION

Technical Problem

As a result of earnest study on transfer apparatus, the present inventors have recognized that, for increasing the commodity value of transfer apparatus, there is room for improvement in management of a transfer-section gap, which is a gap between a web route for a transfer web and a carrying surface for a transfer target object in a transfer section.

The present invention has been made under such a situation, and one of exemplary objects of an aspect of the present invention is to provide a transfer apparatus whose commodity value is increased by appropriate management of the transfer-section gap.

Solution to Problem

To solve the aforementioned problem, the transfer apparatus according to an aspect of the present invention is a transfer apparatus that transfers, in a transfer section, a transfer substance or a surface shape of a transfer web from the transfer web, the transfer web being carried along a web route, to a transfer target object that is carried along a carrying surface, the transfer apparatus including a gap adjustment mechanism that adjusts a size of a gap between the carrying surface and the web route in the transfer section, and a controller that controls the gap adjustment mechanism to adjust the size of the gap to be a size corresponding to a thickness of the transfer target object.

Another aspect of the present invention is also a transfer apparatus. This transfer apparatus includes a web carrying mechanism that carries a transfer web along a web route; a transfer-target-object carrying mechanism that carries a transfer target object; an ultraviolet light source unit that emits ultraviolet light from an emission position on a side opposite to a carrying surface of the transfer-target-object carrying mechanism with respect to the web route in a transfer section in which a transfer substance of the transfer web or a surface shape of the transfer web is transferred to the transfer target object; and a gap adjustment mechanism that raises and lowers the web route in the transfer section and thereby adjusts a gap between the web route and the carrying surface in the transfer section. The ultraviolet light source unit is raised and lowered together with the web route when a size of the gap is more than a threshold value.

Advantageous Effects of Invention

According to the present invention, it is possible to provide a transfer apparatus whose commodity value is increased.

DESCRIPTION OF EMBODIMENTS

Figure 1:
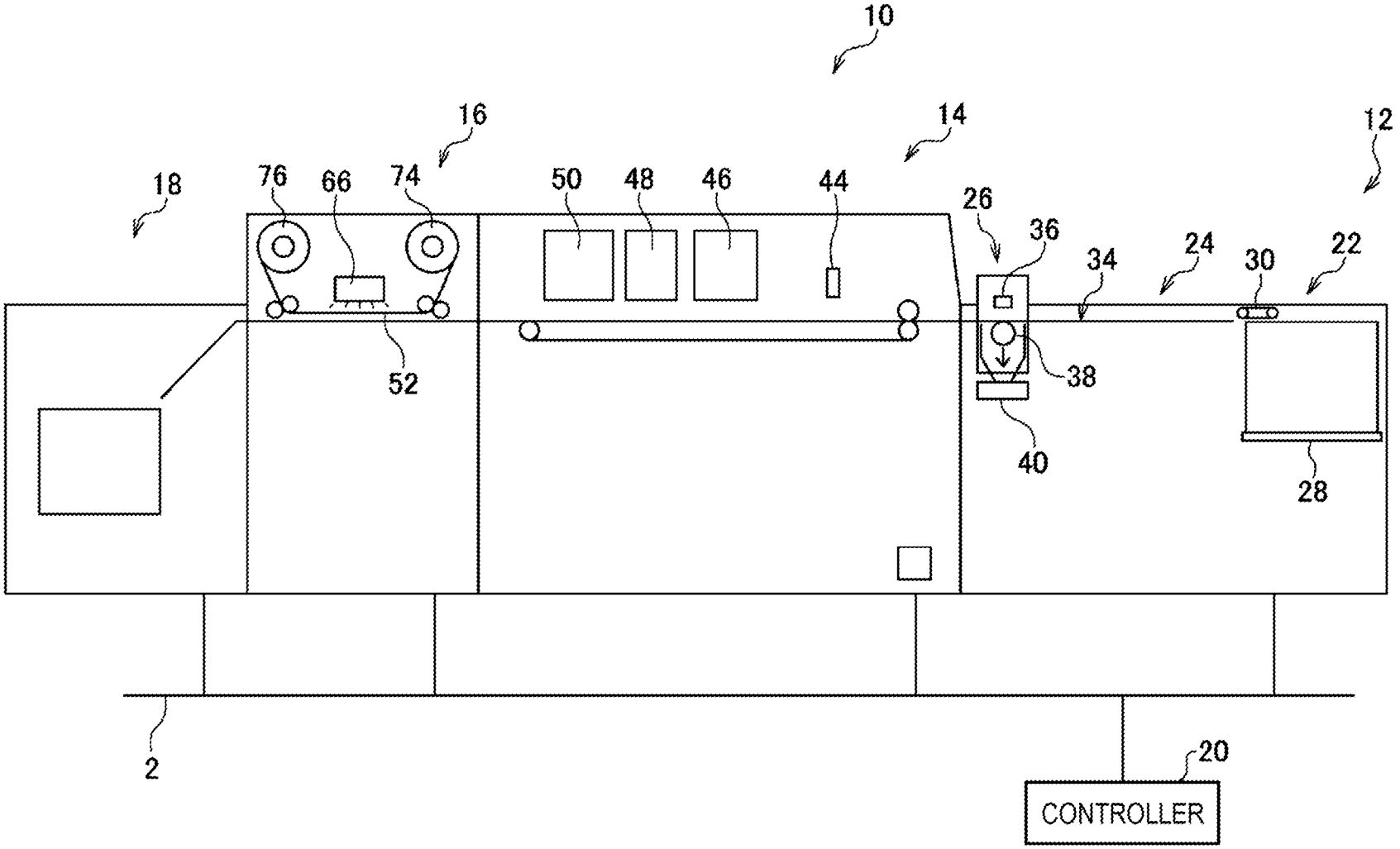
FIG. 1 schematically illustrates a print system in an embodiment.

Hereinafter, the present invention will be described on the basis of a suitable embodiment with reference to the drawings. The embodiment is presented as an example and is not intended to limit the invention, and all the features and combinations thereof described in the embodiment are not necessarily the essence of the invention. Identical or equivalent components, members, and processing illustrated in the drawings are given identical signs, and duplicate description thereof is omitted, as appropriate.

Before specifically describing the present invention, an overview thereof will be described.

A gap between a transfer web and a carrying surface for a transfer target object in a transfer section is naturally required to have a size that allows entrance of the transfer target object. However, when the gap is too large, the transfer web does not come into contact with the transfer target object or a contact pressure between the transfer web and the transfer target object is too low, and when the gap is too small, the contact pressure between the transfer web and the transfer target object is too high. Thus, a contact failure can occur in either cases. As a result, a transfer failure or a carrying failure can occur.

In contrast, the transfer apparatus according to the present invention adjusts the size of a transfer-section gap, which is a gap between a web route for a transfer web and a carrying surface for a transfer target object in a transfer section, to be a size corresponding to the thickness of the transfer target object. Consequently, it is possible to achieve satisfactory transfer.

In addition, when an ultraviolet-curable varnish is applied to a transfer position of a transfer target object and tackiness of the varnish is used to transfer a transfer substance from a transfer web to the transfer target object, ultraviolet light is required to be emitted in a transfer section from an ultraviolet light source unit to the transfer web to cure the varnish. The ultraviolet light source unit emits the ultraviolet light from a distance relatively close to the transfer web, in other words, a distance from which the ultraviolet light of an amount required for curing reaches the transfer web. When the ultraviolet light source unit is disposed at this position, for example, work in mounting or replacing of the transfer web is not easily performed since it is necessary to insert the transfer web into a slight gap between the ultraviolet light source unit and the carrying surface for the transfer target object. In addition, for example, work in accessing the slight gap between the ultraviolet light source unit and the carrying surface for the transfer target object to perform repair of a malfunctioning part, maintenance and inspection, or the like is also not easily performed. In other words, maintenance is also not easily performed.

In contrast, the transfer apparatus according to the present invention can raise also the ultraviolet light source unit in addition to the web route for the transfer web in the transfer section. Consequently, web mounting-replacing work and maintenance are easily performed.

Hereinafter, an embodiment of the present invention will be described specifically. An example in which the transfer apparatus is a foil stamper, that is, a device that transfers foil to a transfer target object will be described below. However, the transfer apparatus is not limited thereto and may be a device that transfers a transfer substance other than foil to a transfer target object. The transfer apparatus also may be a device that performs so-called lamination coating processing, in which a curable coat layer and a transfer web are brought into close contact with each other and a surface shape of the transfer web is transferred to a transfer target object.

Figure 2:
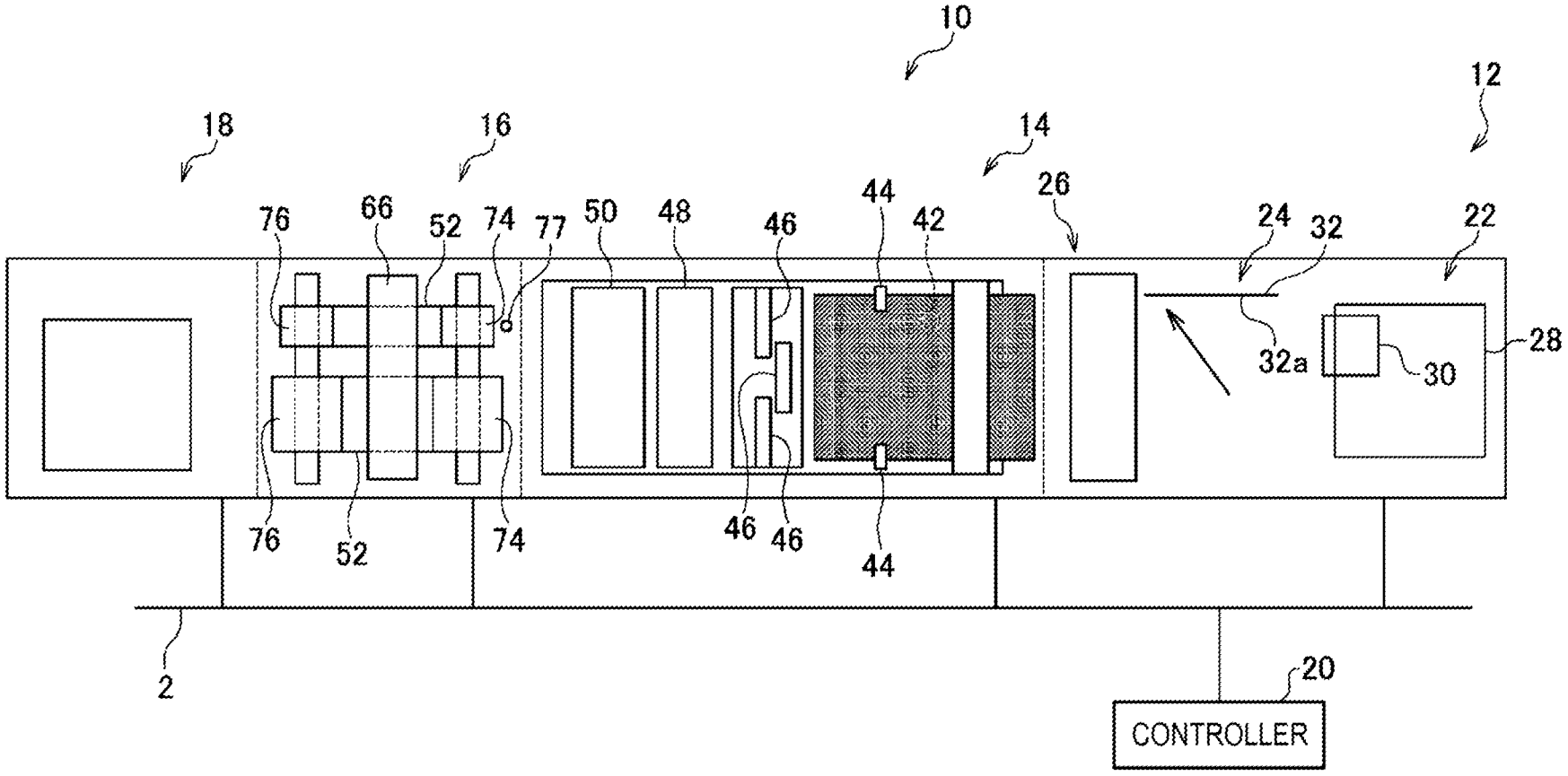
FIG. 2 schematically illustrates a print system in an embodiment.

FIG. 1 and FIG. 2 each schematically illustrate a print system 10 in which a foil stamper 16 according to an embodiment is used. FIG. 1 is a side view, and FIG. 2 is a plan view. The print system 10 is a device that performs predetermined printing on a sheet while carrying the sheet. The material of the sheet is various, such as paper, cloth, resin, or metal. Hereinafter, a direction (direction from right to left in FIG. 1 and FIG. 2) in which a sheet is carried is referred to as a carrying direction Y, and a direction (direction orthogonal to the sheet surface of FIG. 1, or the up-down direction in FIG. 2) orthogonal to the carrying direction Y is referred to as a width direction X. Regarding the width direction X, the right side and the left side as viewed from the upstream side in the carrying direction Y are referred to as the right side in the width direction X and the left side in the width direction X, respectively. In addition, regarding the sheet, an edge of the sheet on the downstream side and an edge of the sheet on the upstream side in the carrying direction Y are referred to as the leading end of the sheet and the tail end of the sheet, respectively.

The print system 10 includes a sheet feeder 12 that feeds sheets one by one; a varnish applicator 14 that applies varnish to sheets that are fed one by one; the foil stamper 16 that transfers foil to varnish on a sheet by using tackiness of the varnish and thereby performs foil stamping; a stacker 18 on which sheets are to be accumulated; and a controller 20 that controls the print system 10 integrally. The sheet feeder 12, the varnish applicator 14, the foil stamper 16, and the stacker 18 are arranged in one row in this order from the upstream side (the right side in FIG. 1 and FIG. 2) in the carrying direction Y. The controller 20 is connected via a network 2 to the sheet feeder 12, the varnish applicator 14, the foil stamper 16, and the stacker 18.

The sheet feeder 12 includes a feeder 22, a corona processing unit 26, and an aligning unit 24. The feeder 22 includes a table 28 and an suction head 30. Sheets are to be stacked on the table 28. The table 28 is configured to be able to be raised and lowered. The suction head 30 delivers the sheets, which are stacked on the table 28, one by one in order from the top.

The aligning unit 24 includes a aligning reference guide 32 that is provided on one end side (the right side in the width direction X in the illustrated example) in the width direction X. The aligning reference guide 32 has a guide surface 32*a* that is orthogonal to the width direction X and that extends in the carrying direction Y. The aligning unit 24 brings a sheet that has been fed by the feeder 22 into contact with the guide surface 32*a*, thereby aligning the position of the sheet in the width direction X.

The corona processing unit 26 includes an electrode 36 that is disposed above a carrying path 34, and a dielectric roller 38 that is disposed below the carrying path 34 to face the electrode 36 vertically. The corona processing unit 26 uses a corona discharge between the electrode 36 and the dielectric roller 38 to perform surface reforming of a sheet that has been fed by the feeder 22. Note that, when a sheet is carried in a state of being sucked on the carrying path 34 by an air suction unit 40, a distance between the electrode 36 and the sheet becomes constant, and the corona discharge is stabilized. In the air suction unit 40, one of suction ports of an exhaust blower, which is not illustrated, is disposed to generate a negative pressure. However, the air suction unit 40 may be configured such that a suction fan is disposed to generate a negative pressure. The passive roller 38 may be rotatable or fixed with respect to a housing of the corona processing unit 26. Further, the shape of the passive roller 38 is not limited to a roller shape as long as the passive roller 38 generates a corona discharge between the electrode 36 and the passive roller 38. The corona processing unit 26 may be disposed on the upstream side of the aligning unit 24.

The varnish applicator 14 includes a sheet sensor 42, a pair of CCD sensors 44, at least one varnish ejector 46, a semi-curing ultraviolet lamp 48, and a complete-curing ultraviolet lamp 50. The pair of CCD sensors 44, the varnish ejector 46, the semi-curing ultraviolet lamp 48, and the complete-curing ultraviolet lamp 50 are disposed to be arranged in this order from the upstream side. The CCD sensors 44 may be CMOS sensors. In the illustrated example, the varnish applicator 14 includes three varnish ejectors 46. The varnish applicator 14 is, however, not limited thereto and may include one varnish ejector 46 that extends over at least the entirety of a region for which printing is required in the width direction X and may include two varnish ejectors 46 or four or more varnish ejectors 46. LEDs that emit ultraviolet light are used in the semi-curing ultraviolet lamp 48 and the complete-curing ultraviolet lamp 50. However, other light sources, such as electric lamps and fluorescent lamps, may be used as long as the light sources emit ultraviolet light. Light sources whose output is adjustable are desirable.

The sheet sensor 42 detects a sheet that has been fed from the sheet feeder 12.

The varnish ejector 46 is a line-type inkjet head but is not particularly limited. The varnish ejector 46 is triggered by detection of the leading end edge of a sheet by the sheet sensor 42 to eject ultraviolet-curable varnish in accordance with varnish ejection data and apply the ultraviolet-curable varnish to the sheet. The varnish ejection data is data that indicates a portion of the sheet to which the varnish is to be applied.

A base image and a plurality of registration marks that serve as reference for specifying a position of the base image may be previously printed on the sheet that is fed by the sheet feeder 12. The varnish applicator 14 applies varnish so as to have a predetermined relationship with the base image in accordance with the varnish ejection data, which specifies a varnish application portion on the sheet, and may apply the varnish so as to, for example, overlap the base image.

Here, there is a possibility that the base image on the sheet is displaced or skewed. Therefore, when varnish is to be applied so as to have a predetermined relationship with the base image, the varnish ejection data is required to be corrected in consideration of displacement and skew. For example, the CCD sensors 44 may be triggered by detection of a sheet by the sheet sensor 42 to image the sheet, and the controller 20 may perform image analysis of image data obtained by the CCD sensors 44 and, based on a difference from theoretical positions of a plurality of registration marks, correct the varnish ejection data of a region surrounded by the registration marks. Note that the method described in Japanese Unexamined Patent Application Publication No. 2016-083898 previously applied by the present applicant is applicable to the above correction.

The semi-curing ultraviolet lamp 48 emits ultraviolet light whose output is relatively suppressed to varnish on a sheet and semi-cures the varnish. Semi-curing means curing varnish slightly (for example, into a state of being able to be further cured) to a degree that does not cause complete curing of the varnish while decreasing the flowability of the varnish.

The varnish in the semi-cured state is completely cured at the foil stamper 16. When foil stamping is not to be performed on the sheet, the semi-curing ultraviolet lamp 48 is normally turned off or output thereof is reduced to be minimal. However, the semi-curing ultraviolet lamp 48 may be used even when foil stamping is not to be performed. For example, when the varnish applied on a sheet easily runs, the semi-curing ultraviolet lamp 48 is turned on to semi-cure the varnish, thereby obtaining an effect of suppressing running of the varnish.

The complete-curing ultraviolet lamp 50 emits ultraviolet light to the varnish that has been applied to a sheet and completely cures the varnish. When foil stamping is to be performed (in other words, foil is to be transferred) on the sheet, the complete-curing ultraviolet lamp 50 is turned off. Although no illustration is provided, there is an exhaust port for exhausting air around the complete-curing ultraviolet lamp 50. A fan for generating an exhaust airflow is provided at this exhaust port. On the upstream side in an air exhaustion direction of this fan, an ozone adsorption filter for adsorbing ozone generated by emission of ultraviolet light is provided with a gap interposed between the fan and the ozone adsorption filter.

In other words, when foil stamping is to be performed on a sheet, varnish is semi-cured by the semi-curing ultraviolet lamp 48, and the varnish in the semi-cured state is completely cured by a foil-stamping ultraviolet lamp 66 of the foil stamper 16. In this case, the complete-curing ultraviolet lamp 50 is turned off. When foil stamping is not to be performed on the sheet, in other words, when only varnish is to be applied to the sheet, the varnish is completely cured by the complete-curing ultraviolet lamp 50. In this case, the semi-curing ultraviolet lamp 48 and the foil-stamping ultraviolet lamp 66 of the foil stamper 16 are turned off. Instead of completely turning off the semi-curing ultraviolet lamp 48, output thereof may be reduced to be minimal. Note that, as described above, the semi-curing ultraviolet lamp 48 may be turned on even when foil stamping is not to be performed. An LED that emits ultraviolet light is used as a light source of the foil-stamping ultraviolet lamp 66. However, another light source may be used as long as the light source emits ultraviolet light.

Figure 3A:
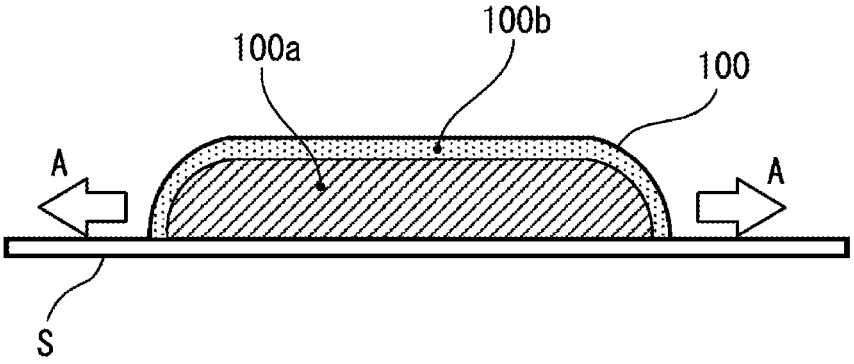
FIGS. 3A and 3B illustrate semi-cured varnish layers.
Figure 3B:
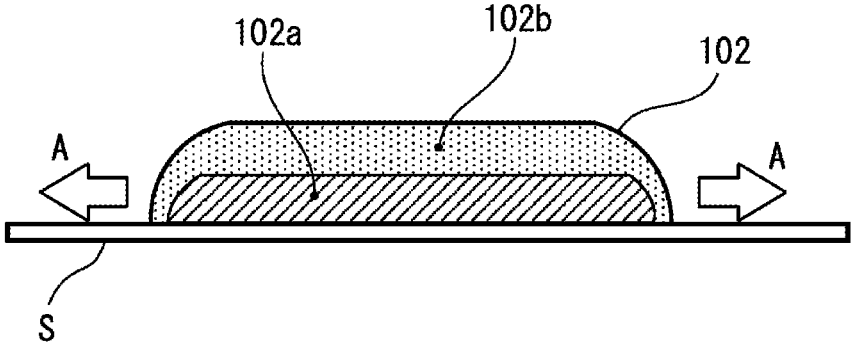

FIGS. 3A and 3B illustrate varnish layers 100 and 102 that have been applied on a sheet S by the varnish ejector 46 and have been semi-cured by the semi-curing ultraviolet lamp 48. The signs 100*a* and 102*a* indicate cured portions that have been cured, and signs 100*b* and 102*b* indicate uncured portions that have been insufficiently cured. The cured portions 100*a* and 102*a* occupy the insides of the varnish layers 100 and 102, respectively, and the uncured portions 100*b* and 102*b* occupy surface layer portions of the varnish layers 100 and 102, respectively. This is because the surface layer portions, which are subjected to outside air, are not easily cured due to an influence of oxygen inhibition.

FIG. 3A and FIG. 3B each illustrate a semi-cured state that is formed by suppressing output of ultraviolet light to a degree that does not cause curing of all of the varnish layers 100 and 102. Output of the semi-curing ultraviolet lamp 48 is relatively stronger in FIG. 3A than in FIG. 3B. Therefore, curing of the varnish layer 100 reaches to a portion closer to the surface layer portion than curing of the varnish layer 102. Consequently, the varnish layer 100 has a more stable shape than the varnish layer 102, and the surface layer portion of the varnish layer 100 does not flow but is not completely cured, and the surface layer portion is in a state of having tackiness. Meanwhile, in contrast to the varnish layer 100, the surface layer portion of the varnish layer 102 has almost no tackiness and has flowability, and, in particular, flowability of a portion in an upper location is high. Therefore, the varnish in the upper location flows even after being semi-cured and exerts a leveling effect of gradually flattening the upper surface.

Ultraviolet light is emitted again at the complete-curing ultraviolet lamp 50 or the foil stamper 16 to the varnish in the semi-cured state to completely cure the varnish. Complete-curing means that all of portions of the varnish layers 100 and 102 are completely cured. In each of the varnish layers 100 and 102 in the semi-cured state, most of a portion bonding to the sheet S is occupied by the cured portion 100*a* or 102*a*, and thus, the bonding portion is stabilized. Therefore, it is possible to suppress occurrence of a situation in which the varnish layer 100 or 102 runs on the sheet S and spreads in a sheet surface direction (arrow A direction) until being completely cured. Thus, the shape of the sheet S in the surface direction is stabilized.

The position of this semi-curing ultraviolet lamp 48 may be configured to be movable in the carrying direction of sheets to enable adjustment of a distance from the varnish ejector 46. During a period from when the varnish is applied by the varnish ejector 46 to when the varnish is semi-cured, the varnish spreads, and a higher leveling effect can be obtained. By enabling adjustment of the distance between the semi-curing ultraviolet lamp 48 and the varnish ejector 46, it is possible to adjust timing of stopping spreading of the varnish and possible to adjust the balance between leveling and shape stability. When the varnish layer is thick, varnish spreads more widely due to the larger volume of the varnish. Thus, it is preferable to dispose the semi-curing ultraviolet lamp 48 to be close to the varnish ejector 46 and suppress spreading of the varnish in an early state. When the varnish layer is thin, it is preferable to dispose the semi-curing ultraviolet lamp 48 to be away from the varnish ejector 46 and take a sufficient time for leveling. When sharpness of characters and the like is relatively required, it is preferable to dispose the semi-curing ultraviolet lamp 48 to be close to the varnish ejector 46 and suppress spreading of the varnish in an early stage.

The foil stamper 16 carries a web (transfer web) 52 by a roll-to-roll method. The web 52 is a foil-holding film in which foil (for example, metal foil) is held by a film (base sheet). The foil stamper 16 uses tackiness of semi-cured-state varnish on a sheet to bond the foil held by the web 52 to the varnish. Then, in a state in which the foil is held by the web 52 and is bonded to the varnish on the sheet, ultraviolet light is emitted by the foil-stamping ultraviolet lamp 66 to the semi-cured-state varnish to which the foil is bonded to completely cure the varnish. Consequently, a state in which a force with which the completely cured varnish bonds to the foil is stronger than a force with which the web 52 holds the foil is obtained. In this state, the sheet and the web 52 are separated, and the foil held by the web 52 can be transferred to a portion on the sheet where the varnish has been applied.

The sheets that have been carried from the foil stamper 16 are to be accumulated on the stacker 18.

The controller 20 is, for example, an information processing terminal, such as a PC. The controller 20 receives an input relating to a definition of a print job. The controller 20 may display a predetermined job management screen and receive an input relating to a definition of a job via the job management screen. The definition of the job includes, for example, the number (the number of sets) of sheets on which printing is to be performed, the sheet sizes of the sheets on which printing is to be performed, varnish data, and presence/absence of foil stamping. Based on the definition of the job, the controller 20 controls the sheet feeder 12, the varnish applicator 14, and the foil stamper 16.

In a step of emitting ultraviolet light with respect to a sheet to which varnish has been ejected by the varnish ejector 46, the controller 20 selects any one of first, second, and third modes that differ from each other in the combination of ultraviolet lamps to be used.

In the first mode, the complete-curing ultraviolet lamp 50 is turned off, and ultraviolet light is emitted by the semi-curing ultraviolet lamp 48 and the foil-stamping ultraviolet lamp 66 with respect to a sheet to which varnish has been ejected by the varnish ejector 46. In the second mode, the foil-stamping ultraviolet lamp 66 is turned off, and ultraviolet light is emitted by the semi-curing ultraviolet lamp 48 and the complete-curing ultraviolet lamp 50 with respect to a sheet to which varnish has been ejected by the varnish ejector 46. In the third mode, the semi-curing ultraviolet lamp 48 and the foil-stamping ultraviolet lamp 66 are turned off, and ultraviolet light is emitted by only the complete-curing ultraviolet lamp 50 with respect to a sheet to which varnish has been ejected by the varnish ejector 46.

The first mode is selected when foil stamping is to be performed at the foil stamper 16. In other words, varnish is semi-cured by the semi-curing ultraviolet lamp 48 when foil stamping is to be performed with respect to a sheet. The output of the semi-curing ultraviolet lamp 48 is set to be relatively stronger than that in the second mode. The shape of the varnish layer is stabilized in a state of having tackiness in the surface layer portion as illustrated in FIG. 3A. By using this tackiness, foil is bonded at the foil stamper 16 to the upper surface of the varnish layer. Since only the surface layer portion is in the uncured state as illustrated in FIG. 3A, the uncured portion is not squashed to spread in the sheet surface direction even when foil is bonded, and the shape of the varnish layer, in particular, the shape in the sheet surface direction is stabilized. In the state in which the foil is bonded to the varnish layer, the varnish in the semi-cured state is completely cured by the foil-stamping ultraviolet lamp 66 to bond the foil to the varnish layer firmly. As a result, the foil whose shape is stabilized can be obtained on the sheet that has been subjected to foil stamping.

The second mode is selected when foil stamping is not to be performed. Varnish on a sheet is semi-cured by the semi-curing ultraviolet lamp 48 also in the second mode. Then, the varnish is completely cured by the complete-curing ultraviolet lamp 50. The foil stamper 16 only allows the sheet to pass therethrough and does not perform foil stamping. Each sheet on which a varnish layer is formed at an application portion of the sheet to which varnish should be applied is discharged onto the stacker 18. The output of the semi-curing ultraviolet lamp 48 may be set to be relatively weaker than that in the first mode. The varnish layer is caused to be in a state in which a relatively large amount of the uncured portion 102*b* remains in the upper location in the surface layer portion as illustrated in FIG. 3B while most of the portion bonding to the sheet S is occupied by the cured portion 102*a* and the bonding portion is stabilized. Therefore, spreading of the varnish can be suppressed, and the shape of the varnish is stabilized. In addition, the varnish of the uncured portion in the upper location flows while being carried to the complete-curing ultraviolet lamp 50 and exerts a leveling effect of flattening the upper surface. It is thus possible to obtain a varnish layer whose upper surface is smooth.

It is also possible in the second mode, since emission of the ultraviolet light is shared by the semi-curing ultraviolet lamp 48 and the complete-curing ultraviolet lamp 50, to disperse heat due to heat radiation of ultraviolet light with respect to the sheet and heat generation of the varnish during curing by the ultraviolet light, compared with the third mode in which complete curing is caused by one light source. Therefore, it is possible to suppress deformation, such as curling, of a heat sensitive sheet and inconvenience, such as a color change of a base image due to heat or melting of toner.

The third mode is selected when foil stamping is not to be performed. In the third mode, semi-curing of varnish on a sheet by the semi-curing ultraviolet lamp 48 is not performed, and only complete-curing of the varnish by the complete-curing ultraviolet lamp 50 is performed. The foil stamper 16 only allows the sheet to pass therethrough and does not perform foil stamping. Each sheet on which a varnish layer having a predetermined shape has been formed at a predetermined position on the sheet is to be discharged onto the stacker 18. Since semi-curing is not performed, the leveling effect during carrying to the complete-curing ultraviolet lamp 50 is increased, and a varnish layer whose upper surface is smoother can be obtained. In the third mode, instead of completely turning off the semi-curing ultraviolet lamp 48, output thereof may be reduced to be minimal.

With the first, second, and third modes being selective, it is possible to obtain an apparatus that can form a higher-quality varnish layer even when only varnish is applied to a sheet.

The controller 20 selects a mode on the basis of an inputted definition of a print job. When the print job includes foil stamping, the first mode is selected. When the print job does not include foil stamping, the second or third mode is selected.

Since the varnish layer obtained in the second mode has passed through a semi-cured state, the varnish layer has an effect of preventing the varnish layer from running and spreading in the sheet surface direction. Therefore, the second mode is suitable for, in particular, a job that requires avoidance of spreading and requires stabilization of the shape of the varnish layer in the sheet surface direction.

For example, when the thickness of the varnish layer is large, the varnish spreads more easily due to the large thickness. Therefore, the second mode may be selected when a region in which the thickness of the varnish layer is more than or equal to a predetermined thickness is included. Meanwhile, when an object in which the area of a region to which the varnish layer should be applied is small is included or the smallest width of the varnish layer in the sheet surface direction is narrow, and when a portion whose distance from the varnish layer adjacent thereto is small is included, the shape of the region to which the varnish has been applied easily deforms due to spreading of the varnish layer. Therefore, in a print job, image analysis of the varnish data that specifies a varnish application portion on a sheet may be performed, and when, for example, the area of an object to which varnish should be applied is less than or equal to a predetermined area, the minimum width of the varnish layer in the sheet surface direction is less than or equal to a predetermined width, or a distance from an adjacent varnish layer is less than or equal to a predetermined distance, the second mode may be selected. In addition, when a print job includes a type of varnish, a type of a sheet, or types of both of them, the second mode may be selected when the type of the varnish or the sheet or the types of a combination thereof are types that cause spreading easily. The third mode, in which an excellent leveling characteristic can be obtained, is selected in cases that do not fit these conditions for selecting the second mode. It is possible in the third mode by setting the output of the semi-curing ultraviolet lamp 48 to be minimal, instead of completely turning off the semi-curing ultraviolet lamp 48, to suppress spreading of varnish even slightly while obtaining an excellent leveling characteristic and to further improve the aesthetic appearance of the varnish layer.

To select one of the first, second, and third modes, the controller 20 may receive an input from a user and select a mode inputted by the user. Alternatively, the controller 20 may select the first mode automatically only when the print job includes foil stamping and may receive an input from a user when the print job does not include foil stamping to select one of the second and third modes. It is necessary to select the first mode to perform foil stamping because the second and third modes are required to be selected in consideration of a spreading state in actual printing in some cases. A mode that is selected as a selection candidate by the same algorithm as that for performing automatic selection may be displayed as a recommended mode in an input screen for a user by the controller 20.

The above is the basic configuration of the print system 10.

As a modification, the print system 10 may include, as an alternative to the sheet feeder 12, a printer that prints a base image and registration marks on a sheet, and sheets may be fed one by one from the printer.

The print system 10 also may include, between the foil stamper 16 and the stacker 18, a post-processing device that cuts and binds sheets, a second varnish application unit for protecting foil surfaces, an interleaf inserting device for a purpose of surface protection, a punching device that punches a sheet into a predetermined shape and forms a carton material or the like, a post-processing device for a purpose of surface protection of interleaves or the like, and the like.

Figure 4:
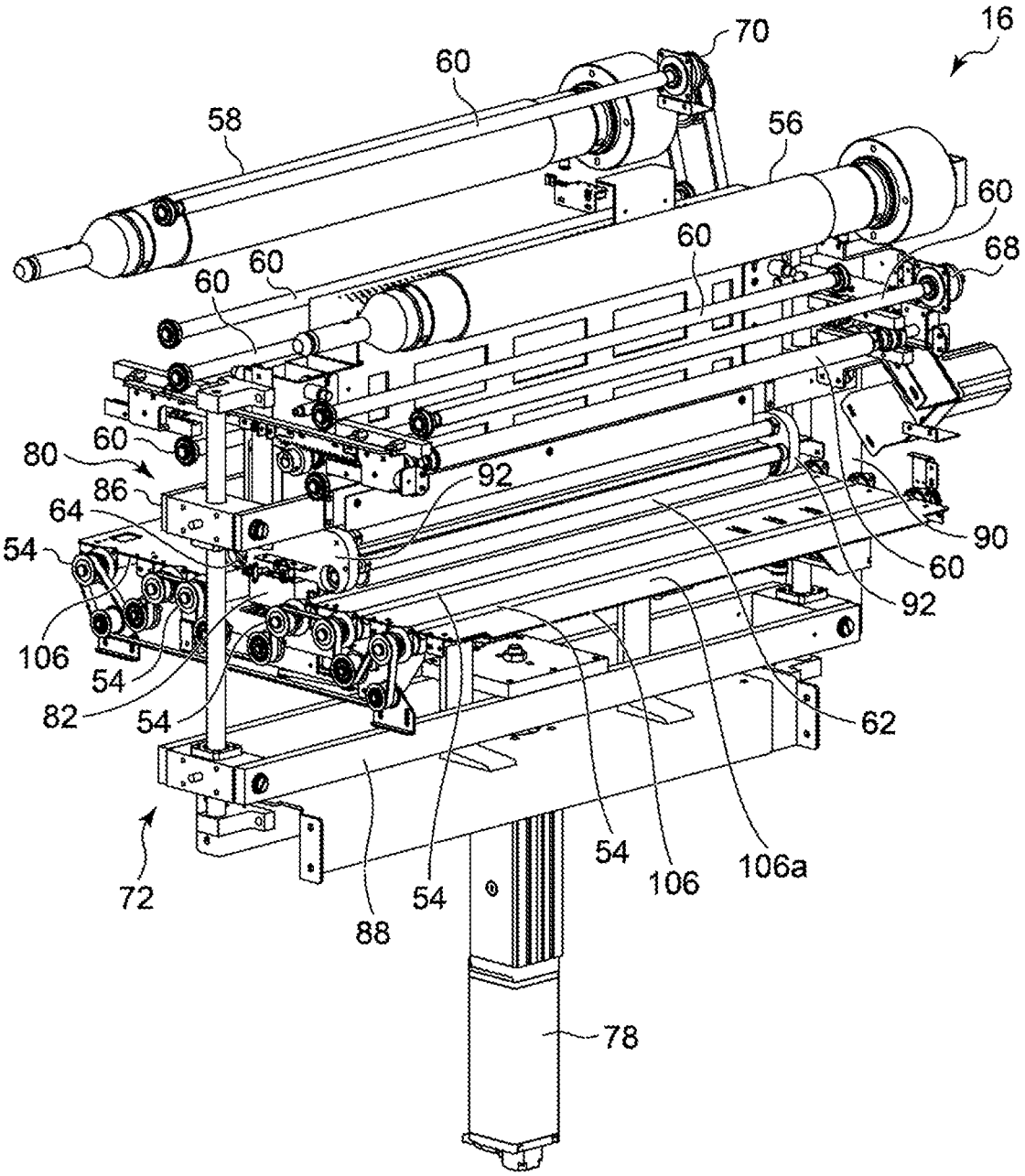
FIG. 4 illustrates a foil stamper in FIG. 1.
Figure 5:
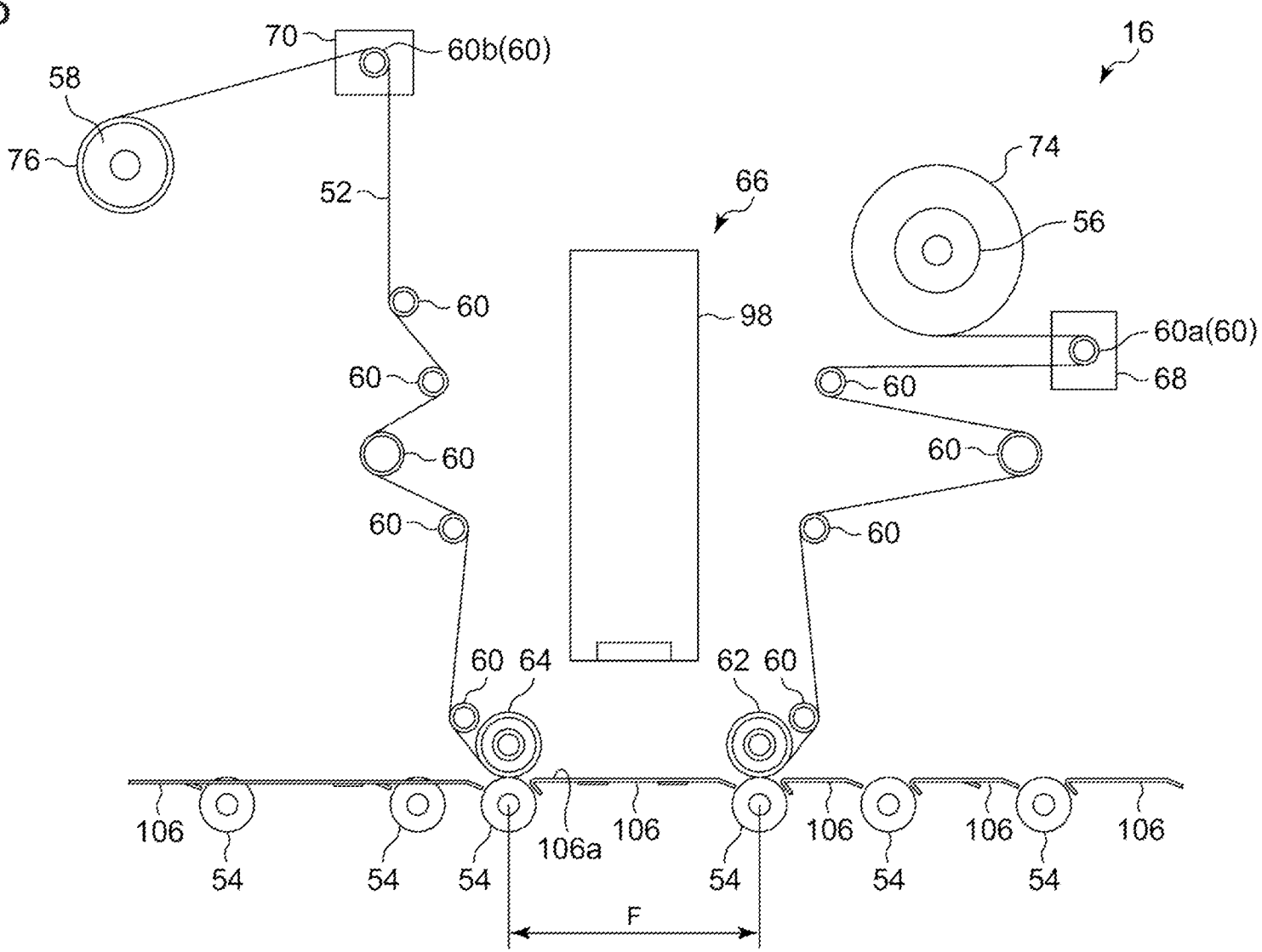
FIG. 5 illustrates the foil stamper in FIG. 1.
Figure 6:
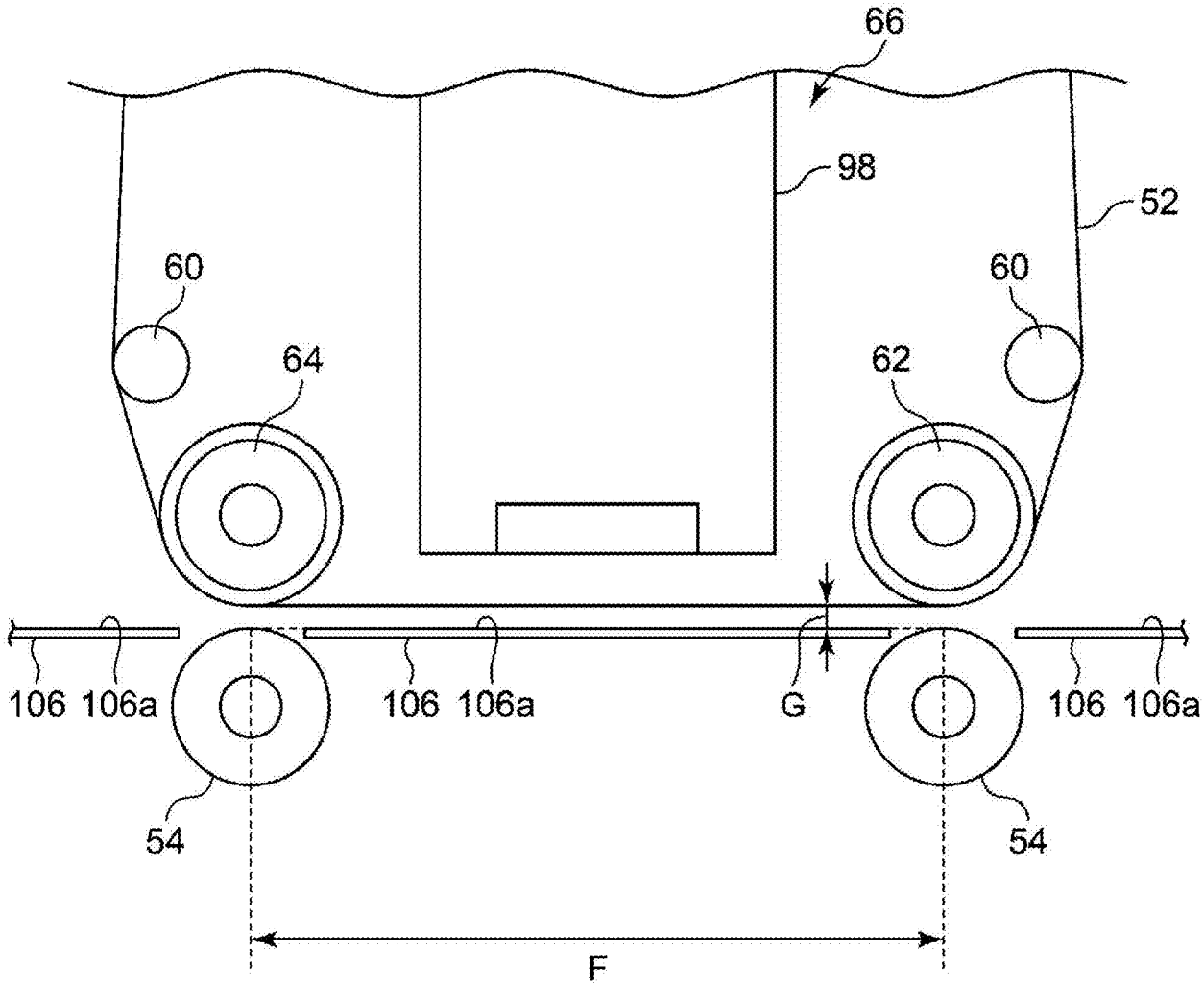
FIG. 6 illustrates, in an enlarged manner, the periphery of a foil stamping section of the foil stamper in FIG. 1.

Next, a configuration of the foil stamper 16 will be described in detail. FIG. 4 and FIG. 5 each illustrate the foil stamper 16. FIG. 4 is a perspective view, and FIG. 5 is a side view. FIG. 6 illustrates, in an enlarged manner, the periphery of a foil stamping section (described later).

The foil stamper 16 includes a plurality of carrying rollers 54, an unwinding shaft 56, a winding shaft 58, a plurality of guide rollers 60, a first nip roller 62, a second nip roller 64, a foil-stamping ultraviolet lamp (ultraviolet light source unit) 66, a first brake mechanism 68, a second brake mechanism 70, a gap adjustment mechanism 72, a sheet detection sensor 77, and a carriage guide 106.

The plurality of carrying rollers 54 carry a sheet toward the downstream side in the carrying direction while nipping the sheet between the carrying rollers 54 and a sheet pressing roller, which is not illustrated, the nip roller 62, or the nip roller 64.

The unwinding shaft 56 supports a roll (hereinafter referred to as the unwind roll 74) of an unused web. The winding shaft 58 winds into a roll shape the web 52 that has been used, in other words, a film and foil that remains on the film. Hereinafter, the roll-shaped web 52 wound by the winding shaft 58 is referred to as the wound roll 76.

The unwinding shaft 56 and the winding shaft 58 are each constituted by a friction shaft. The friction shaft includes an outer peripheral ring that holds a paper tube serving as a core of the unwind roll 74 or the wound roll 76 and a shaft center portion that holds the outer peripheral ring rotatably, and the friction shaft is configured such that holding torque, which is resistance when the outer peripheral ring is rotated with respect to the shaft center portion, can be adjusted. When an external force of attempting to rotate the outer peripheral ring with respect to the shaft center portion acts, the outer peripheral ring rotates with respect to the shaft center portion when rotational torque generated by the external force is larger than the holding torque, and the outer peripheral ring maintains the state of being stopped with respect to the shaft center portion when the rotational torque is smaller than the holding torque. The holding torque can be varied by adjusting the air pressure of air that fills the inside of the shaft.

The friction shaft has a structure that includes a plurality of the outer peripheral rings in an axial direction and that allows rotational speed to be different depending on positions in the axial direction (that is, the width direction X). Specifically, only some of the plurality of outer peripheral rings may rotate while the other outer peripheral rings stop. Further, the rotational speed may differ between the outer peripheral rings that rotate. Each outer peripheral ring includes, at the outer periphery thereof, a spherical body that moves radially outward to engage with the paper tube when receiving torque in an unwinding direction of the unwinding shaft 56 or a winding direction of the winding shaft 58 and fixes the outer peripheral ring and the paper tube to each other. When the paper tube is to be extracted, torque in an opposite direction is applied to the paper tube to move the spherical body radially inward and cancel the engagement with the paper tube. However, when the opposite-direction torque applied to the paper tube is larger than the holding torque, the outer peripheral ring is rotated together and makes it difficult to cancel the engagement of the spherical body and to extract the paper tube. To prevent this, the air pressure may be increased to increase the holding torque when the paper tube is to be extracted.

The holding torque is set for the unwinding shaft 56 such that each outer peripheral ring rotates with respect to the fixed shaft center portion when, in the foil stamping section (a section between the first nip roller 62 and the second nip roller 64) F in which the web 52 and a sheet come into contact with each other, a force of causing the web 52 to rotate together with the sheet or the carrying rollers 54 acts and a force of pulling out the web 52 from the unwind roll 74 acts. During a non-transferring time, the air pressure of the unwinding shaft 56 is increased to increase the holding torque to be larger than that during a transferring time. The holding torque of the winding shaft 58 is set to be smaller than the holding torque of the unwinding shaft 56 regardless of the transferring time or the non-transferring time, and the shaft center portion of the winding shaft 58 is driven to rotate by a driving source, which is not illustrated. Therefore, sagging of the web can be prevented during both the transferring time and the non-transferring time.

The plurality of guide rollers 60, the first nip roller 62, and the second nip roller 64 define a substantially U-shaped carrying route (hereinafter referred to as the web route) for the web 52 from the unwind roll 74 to the wound roll 76. The second nip roller 64 is adjacent, on the downstream side of the web route, to the first nip roller 62. The first nip roller 62 and the second nip roller 64 define a horizontally extending section of the web route. The section corresponds to the foil stamping section F in the present embodiment.

In the foil stamping section F, foil is transferred from the web 52 to semi-cured-state varnish on a sheet. During transferring, the varnish on the sheet and the web 52 are temporarily bonded to each other, and the web 52 is thus fed at the same speed as the sheet. The second nip roller 64 may be driven to rotate to feed the web 52 at the same speed as the sheet. Here, when a driving source that rotationally drives the nip rollers 62 and 64 is provided and a speed difference in surface movement speed is generated between the nip rollers 62 and 64 and the carrying rollers 54 that the nip rollers 62 and 64 face, a speed difference is generated between the web 52 that holds foil, the web 52 being in contact with the nip rollers 62 and 64, and the sheet to which the foil is to be transferred, the sheet being in contact with the carrying rollers 54, and may cause a transfer failure by causing a crease of the foil or causing the positional relationship between the foil and the sheet in the carrying direction to be displaced during a period from when the varnish on the sheet comes into contact with the web 52 to when the varnish is cured. In contrast, the present embodiment employs a configuration in which a driving source that rotationally drives the nip rollers 62 and 64 is not provided and in which the nip rollers 62 and 64 are rotated by following the movement of the web 52. Thus, a transfer failure due to generation of a crease of foil or generation of displacement between the foil and the sheet is suppressed.

With respect to at least one of the guide rollers 60, an encoder (not illustrated) for detecting the rotation speed thereof is attached. It is preferable to reduce sliding of the guide roller 60 to which the encoder is attached with respect to the web 52 by, for example, using a material having a high friction coefficient in a surface of the guide roller 60. In the foil stamping section F, the foil on the outer peripheral surface of the web 52 comes into contact with a sheet or surfaces of the carrying rollers 54, and the web 52 rotates together with these surfaces and thereby moves toward the downstream side in the carrying direction of the sheet. The controller 20 calculates an actual movement speed of the web 52 on the basis of a result of detection by the encoder. The controller 20 also controls the rotation speed of the unwinding shaft 56 in consideration of the outer diameter of the unwind roll 74 detected by a laser sensor or the like (not illustrated) provided on the radially outer side of the unwind roll 74 such that a theoretical speed of unwinding the web 52 from the unwind roll 74 when each outer peripheral ring and the shaft center portion rotate at the same speed is slower than the calculated actual movement speed of the web 52. At this time, while the movement speed of the web 52 is faster than the speed of feeding by the rotation of the unwinding shaft 56, it is possible, by rotating the outer peripheral rings of the unwinding shaft 56, which is constituted by the friction shaft, with respect to the shaft center portion including a drive input shaft and rotating the outer peripheral rings faster than the drive input shaft, to feed the web 52 at a speed that is the same as the movement speed of a sheet in the foil stamping section F while keeping the tensed state of the web 52. Note that the unwinding shaft 56 may be configured to constantly rotate, even when the outer diameter of the unwind roll 74 is maximum, at a predetermined rotational speed at which the theoretical speed of unwinding the web 52 is slower than an actual movement speed.

The controller 20 also controls the rotation speed of the winding shaft 58 such that the speed of winding of the web 52 by the wound roll 76 is faster than the movement speed of the web 52. At this time, while the movement speed of the web 52 is slower than the speed of winding by the rotation of the unwinding shaft 56, it is possible, by rotating the peripheral surface of the winding shaft 58, which is constituted by the friction shaft, with respect to the drive input shaft and causing the drive input shaft to be in a state of idling with respect to the peripheral surface, to wind the web 52 at the same speed as the movement speed of a sheet in the foil stamping section F while keeping the tensed state of the web 52.

The foil-stamping ultraviolet lamp 66 is provided above the web route between the first nip roller 62 and the second nip roller 64. The foil-stamping ultraviolet lamp 66 includes a light source, which is not illustrated, that emits ultraviolet light and a light-source support portion 98 that supports the light source. The light-source support portion 98 is supported by a lamp stopper 104 that is fixed to a housing of the foil stamper 16. The light-source support portion 98 is supported, in particular, at a hook member **98*a* thereof by the lamp stopper 104**.

The carriage guide 106 has a flat upper surface **106*a* and supports a sheet by the upper surface 106*a*** to guide carrying of the sheet.

The sheet detection sensor 77 is a sensor that detects presence/absence of a sheet at a detection position and can detect timing of passage of the leading end of the sheet and timing of passage of the tail end of the sheet on the basis of a detection result.

The gap adjustment mechanism 72 raises and lowers the first nip roller 62, the second nip roller 64, and the foil-stamping ultraviolet lamp 66. The gap adjustment mechanism 72 may raise and lower also some of the guide rollers 60, for example, the guide rollers 60 that are adjacent to the nip rollers 62 and 64.

For example, to achieve satisfactory foil stamping, the gap adjustment mechanism 72 raises or lowers the nip rollers 62 and 64 and adjusts the gap G between the web route and the carrying surface in the foil stamping section to be a size corresponding to the thickness of a sheet to which foil stamping is to be performed. The web route in the foil stamping section may be, for example, a route that connects the lower surface (a lowest portion of the outer peripheral surface) of the first nip roller 62 and the lower surface (the lowest portion of the outer peripheral surface) of the first nip roller 62 to each other. The carrying surface may be the upper surface 106*a* of the carriage guide 106 and may be the upper surfaces (highest portions of the outer peripheral surfaces) of the carrying rollers 54 that face the nip rollers 62 and 64. Therefore, the size of the gap G may be a distance in the up-down direction between the nip roller 62 or 64 and the carriage guide 106 or the carrying rollers 54 facing the nip rollers 62 or 64.

When the nip rollers 62 are 64 are lowered, a movement route for the web 52 from the unwind roll 74 to the wound roll 76 is lengthened. At this time, the peripheral surface rotates faster with respect to the drive input shaft of the unwinding shaft 56, and the web 52 of an amount corresponding to an increased length of the movement route is unwind. Meanwhile, when the nip rollers 62 and 64 are raised, the movement route for the web 52 from the unwind roll 74 to the wound roll 76 is shortened. At this time, the peripheral surface rotates faster without idling of the drive input shaft of the winding shaft 58, and the web 52 of an amount corresponding to a decreased length of the movement route is wound, which can suppress sagging of the web 52.

The first brake mechanism 68 brakes one guide roller (hereinafter also referred to as the guide roller 60*a*) among the plurality of guide rollers 60 on the upstream side of the first nip roller 62 not to be able to rotate and cancels braking to enable rotation of the guide roller 60*a*. Although not particularly limited, the first brake mechanism 68, for example, includes an electromagnetic brake that is provided on one end side in an axial direction (that is, the width direction X) of the guide roller 60*a*.

The second brake mechanism 70 brakes one guide roller (hereinafter also referred to as the guide roller 60*b*) among the plurality of guide rollers 60 on the downstream side of the second nip roller 64 not to be able to rotate and cancels braking to enable rotation of the guide roller 60*b*. Although not particularly limited, the second brake mechanism 70, for example, includes an electromagnetic brake that is provided on one end side in an axial direction of the guide roller 60*b*.

In a state in which braking by the brake mechanisms 68 and 70 has been cancelled, the guide rollers 60*a* and 60*b* rotate by following the fed web 52. In a state in which braking has been performed by the brake mechanisms 68 and 70, rotation of the guide rollers 60*a* and 60*b* is disabled, and movement of the web 52 is braked.

Here, the winding shaft 58 in the present embodiment rotates at a constant speed regardless of whether a sheet is passing the foil stamping section F, the remaining amount of the web 52, and the number of the unwind rolls 74. The rotation speed thereof is required to be a degree that maintains the tension of the web 52 even during transferring of foil. The speed of a sheet that passes through the foil stamping section F is constant. The speed of the web 52 that moves with the movement of the sheet in the foil stamping section F is thus also constant. Therefore, the rotation speed required to maintain the tension of the web 52 becomes faster as the diameter of the wound roll 76 decreases. Therefore, the rotation speed of the winding shaft 58 is required to be a degree that can maintain the tension sufficiently even when the wound roll 76 has a minimum diameter. Meanwhile, when the wound roll 76 has a large diameter, torque that is required for winding increases, and a force of pulling foil at a stop time by an inertial force also increases. If no brake mechanism is provided, in other words, a movement of the web 52 is braked by only friction torque of the friction shafts of the unwinding shaft 56 and the winding shaft 58, the web 52 is fed slightly even after passage of a sheet through the foil stamping section F. Since a fed portion thereof is wound, foil is wasted. This tendency can be suppressed when the rotation speed of the winding shaft 58 is decreased. However, as described above, the rotation speed of a degree that can maintain the tension sufficiently even when the wound roll 76 has a minimum diameter is required, and it is thus not possible to decrease the rotation speed to be lower than the degree. In contrast, due to the presence of the brake mechanisms 68 and 70, it is possible to immediately stop feeding of the web 52 by the friction shafts and the brake mechanisms 68 and 70 that work together and possible to suppress waste of foil.

In addition, the frictional force of the friction shaft of the winding shaft 58 is constantly constant regardless of whether a sheet is passing the foil stamping section F, the remaining amount of the web 52, and the number of the unwind rolls 74. While the friction shafts can be adjusted the intensity mechanistically, the reactivity of the friction shafts is poor since air is input thereto to control the frictional force. Increasing the frictional force of the friction shafts at a stop time may be considered. However, it takes time for the frictional force to increase. If the frictional force of the friction shafts is set to be constantly strong, it may be possible to perform an instantaneous stoppage. However, since the winding shaft 58 rotates constantly, the tension applied to the web 52 is too strong and causes stretching of the web 52. In addition, adjusting the frictional force (air pressure) of the friction shafts in accordance with the remaining amount of the web 52 may be also considered. It is possible, regardless of the remaining amount of the web 52, to prevent malfunction by increasing the air pressure as the remaining amount becomes larger. However, in a case where a plurality of the unwind rolls 74 are present and the remaining amounts thereof differ from each other greatly, when the air pressure is increased by a degree that is for an unwind roll 74 having a larger diameter, excessive tension is applied to another unwind roll 74 having a smaller diameter and causes stretching of the web 52. In contrast, due to the presence of the brake mechanisms 68 and 70, it is possible to brake the movement of the web by the electromagnetic brakes before the web is wound around the wound roll 76. It is thus possible to apply braking uniformly regardless of the sizes of the diameters and possible to cancel braking when foil is to be transferred. Therefore, even when a plurality of the wound rolls 76 are present, it is possible to suppress waste feeding of the web 52.

Figure 7:
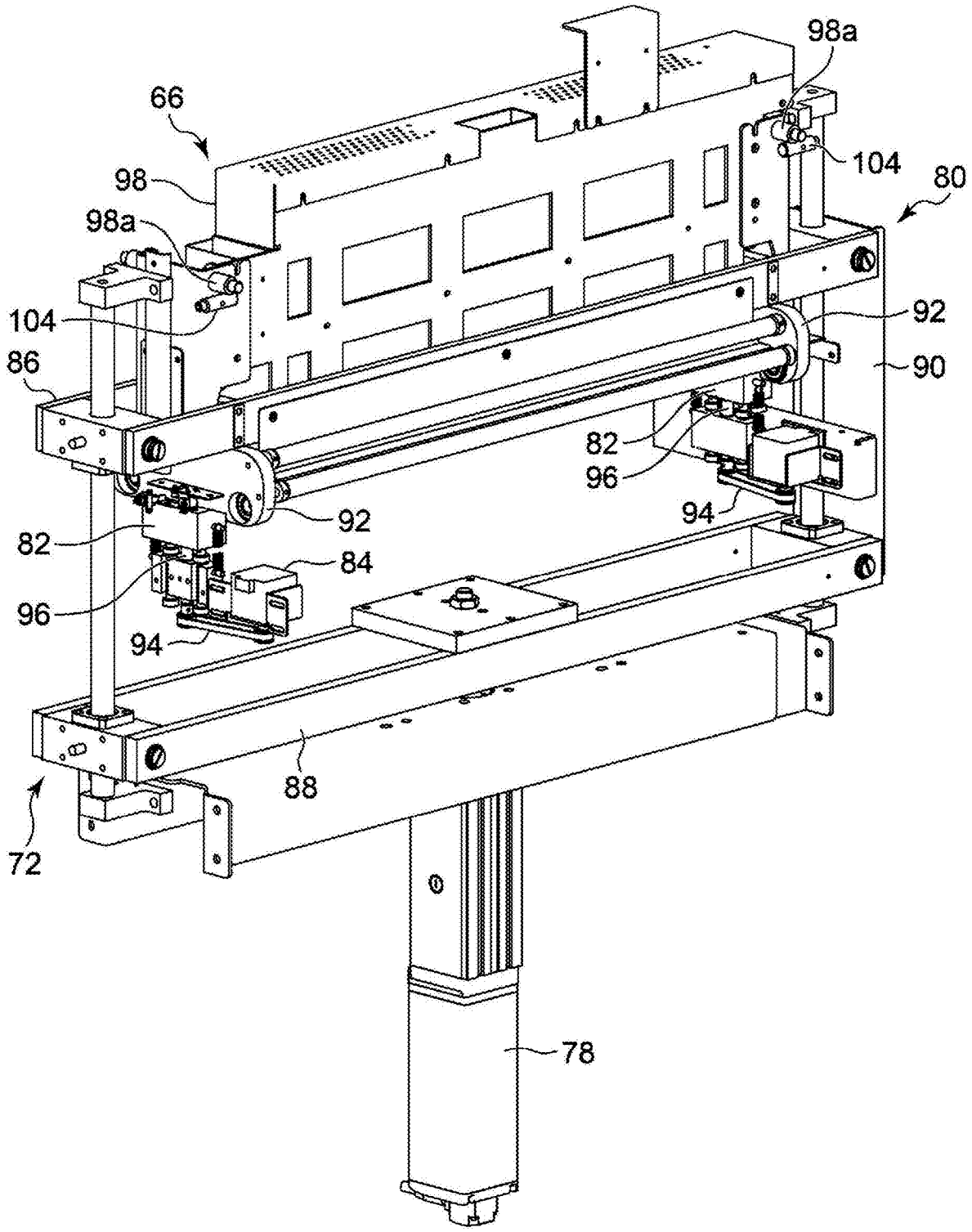
FIG. 7 illustrates a gap adjustment mechanism in FIG. 4 and the periphery thereof.
Figure 8:
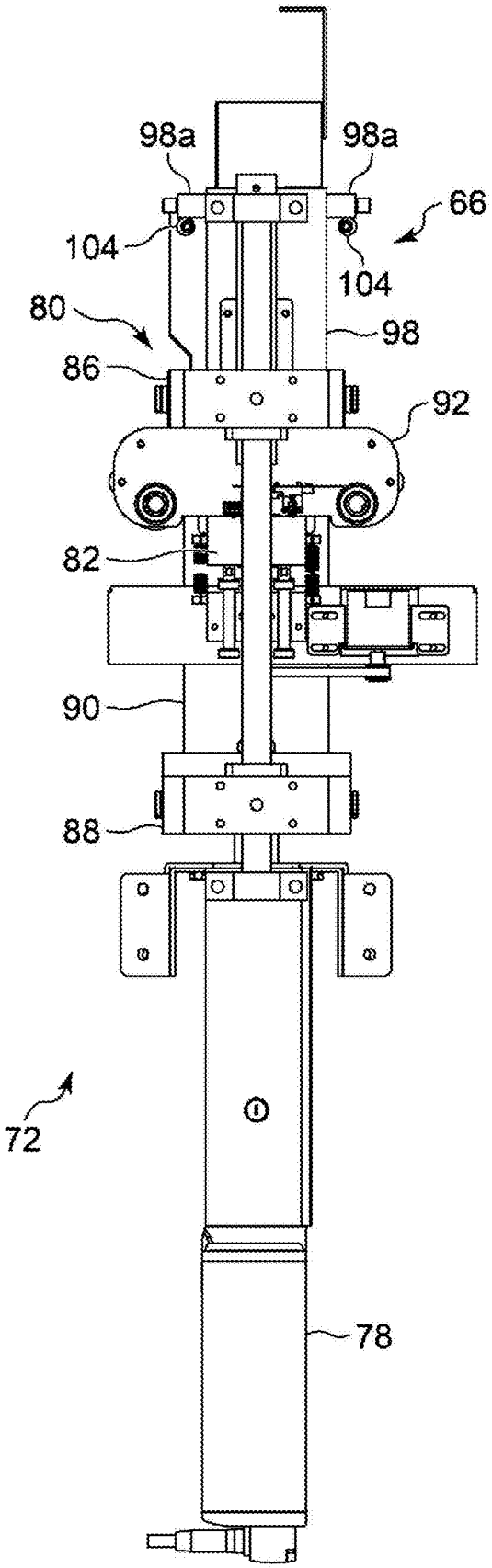
FIG. 8 illustrates the gap adjustment mechanism in FIG. 4 and the periphery thereof.
Figure 9:
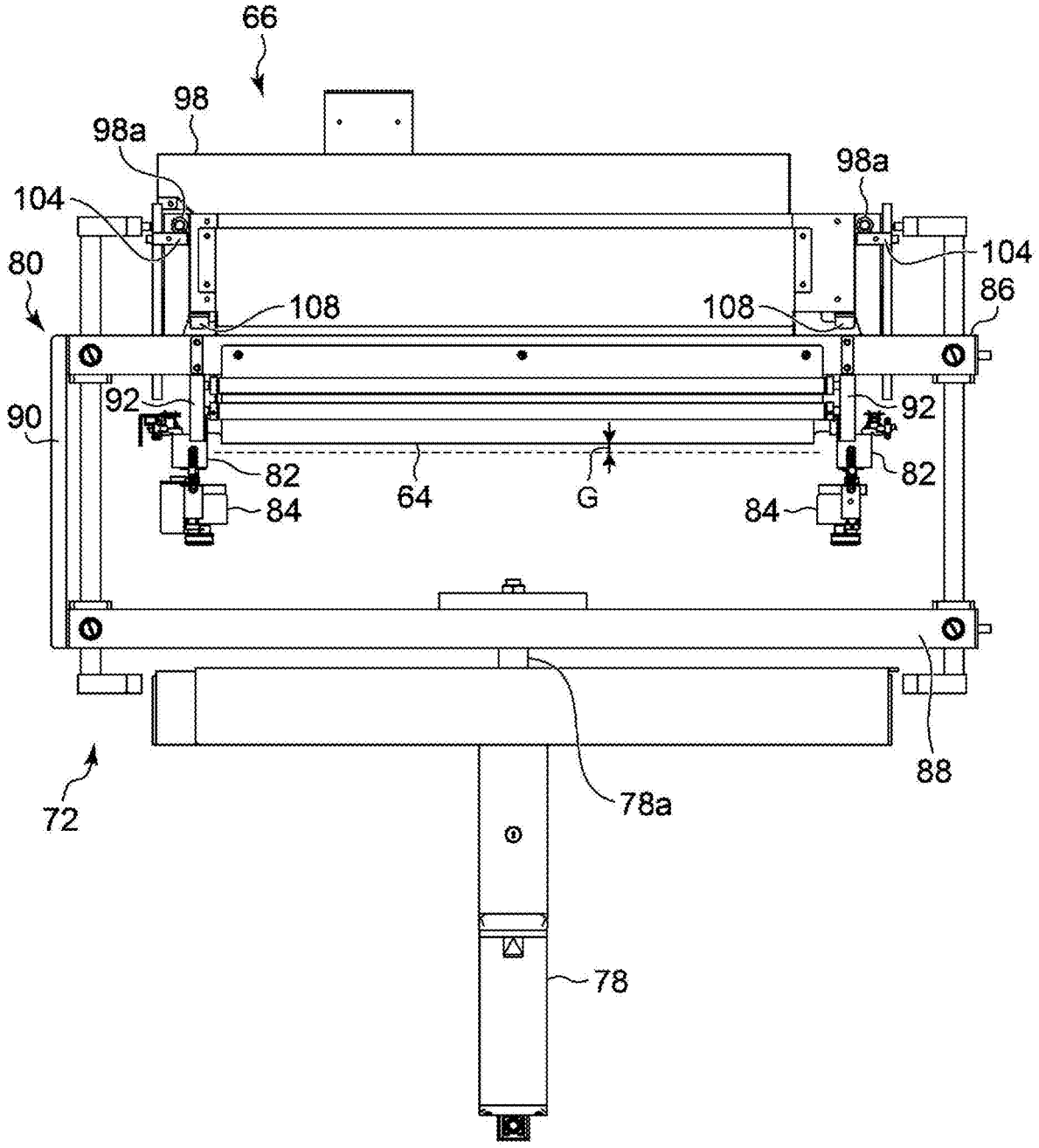
FIG. 9 illustrates the gap adjustment mechanism in FIG. 4 and the periphery thereof.
Figure 10:
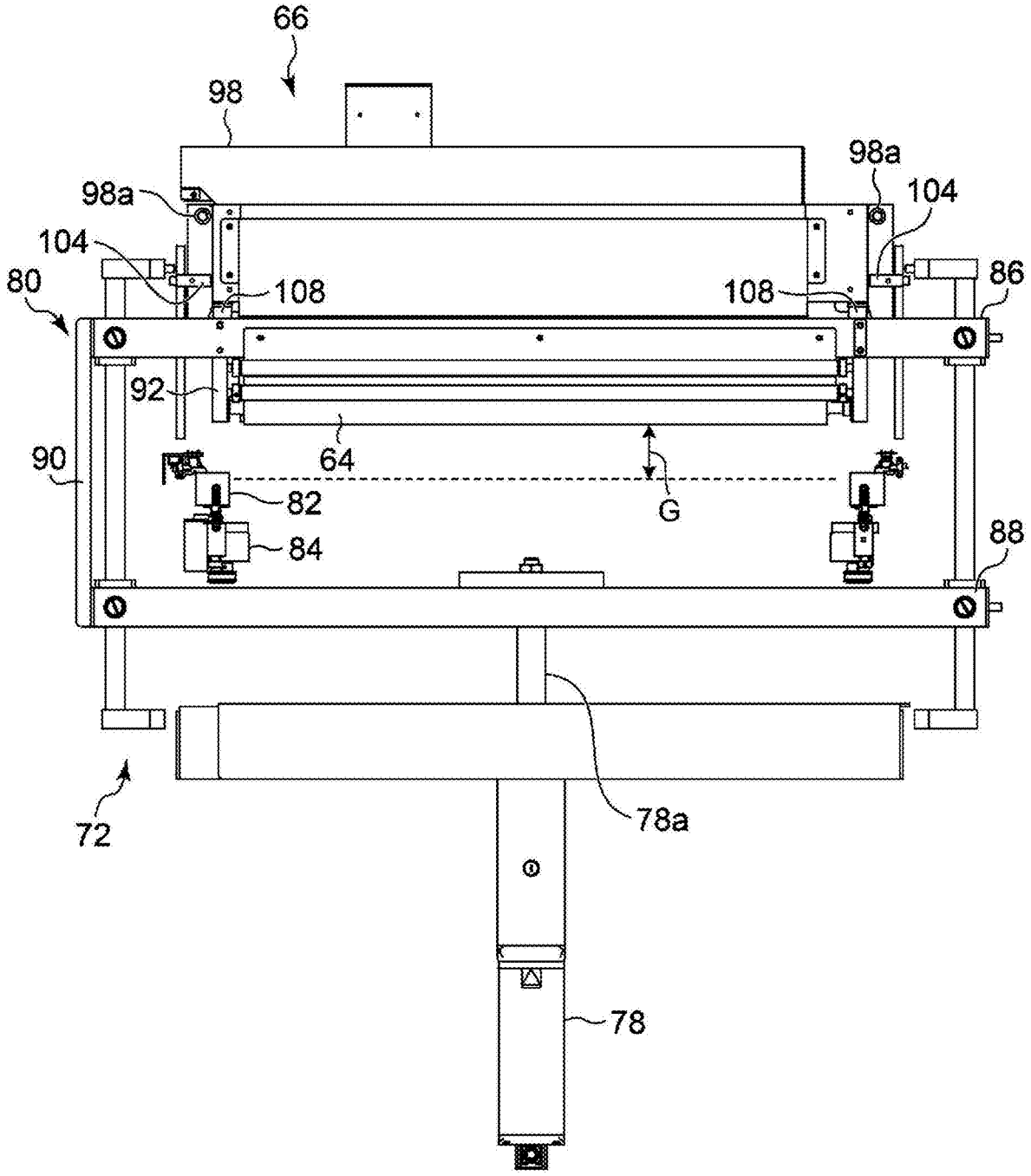
FIG. 10 illustrates the gap adjustment mechanism in FIG. 4 and the periphery thereof.

Next, the gap adjustment mechanism 72 will be described in detail. FIG. 7 to FIG. 10 each illustrate the gap adjustment mechanism 72 and the periphery thereof. FIG. 7 is a perspective view, FIG. 8 is a side view as viewed in the width direction X, and FIG. 9 and FIG. 10 are side views as viewed from the downstream side in the carrying direction Y. FIG. 9 illustrates a state in which the nip rollers 62 and 64 and the foil-stamping ultraviolet lamp 66 are lowered to positions for performing foil stamping, and FIG. 10 illustrates a state in which the nip rollers 62 and 64 and the foil-stamping ultraviolet lamp 66 are raised for web mounting-replacing work.

The gap adjustment mechanism 72 includes an electric cylinder (presser) 78, a nip roller support 80, two stoppers 82, and two stepping motors 84.

The nip roller support 80 includes an upper frame 86, a lower frame 88, a coupling frame 90, and two blocks 92. The upper frame 86 and the lower frame 88 are spaced apart from each other in the up-down direction and extend in the width direction X to overlap each other in plan view. The upper frame 86 is positioned on the upper side of the carriage guide 106, and the lower frame 88 is positioned on the lower side of the carriage guide 106. The coupling frame 90 extends in the up-down direction and couples the upper frame 86 and the lower frame 88 to each other on one end side in the width direction. The two blocks 92 are fixed to the lower surface of the upper frame 86 at a right-side portion and a left-side portion in the width direction X, respectively. The two blocks 92 are positioned on the upper side of the carriage guide 106 and support two ends of each of the nip rollers 62 and 64 so as to hold the nip rollers 62 and 64 therebetween.

The electric cylinder 78 is provided below the nip roller support 80. A rod 78*a* of the electric cylinder 78 is connected to the lower frame 88 of the nip roller support 80. The electric cylinder 78 raises and lowers the nip roller support 80 and eventually the nip rollers 62 and 64.

The two stoppers 82 are provided on two sides in the width direction. The positions of the two stoppers 82 in the up-down direction are adjustable individually from each other by the stepping motors 84 corresponding thereto. Specifically, the rotary driving force of the stepping motors 84 is transmitted through a transmission belt 94 to a drive shaft (ball screw) 96. When the drive shaft 96 rotates, the stoppers 82 are raised or lowered in accordance with a direction of the rotation.

When the nip roller support 80 is lowered, the two blocks 92 each stop by coming into contact with the stoppers 82 corresponding thereto and limit further lowering of the nip roller support 80. In other words, the positions of the stoppers 82 in the up-down direction determine the positions of the nip rollers 62 and 64 in the up-down direction and eventually the size of the gap G.

When the nip roller support 80 is raised to a certain height position, the upper surface of the upper frame 86 of the nip roller support 80 comes into contact with a rubber leg 108 that is fixed to the lower surface of the light-source support portion 98 of the foil-stamping ultraviolet lamp 66. When the nip roller support 80 is further raised, the foil-stamping ultraviolet lamp 66 is supported by the nip roller support 80 and raised. In other words, the foil-stamping ultraviolet lamp 66 is separated from the lamp stopper 104 into a state of not being supported by the lamp stopper 104. In a state of being supported by the nip roller support 80, the foil-stamping ultraviolet lamp 66 moves upward and downward together with the nip roller support 80. In other words, the foil-stamping ultraviolet lamp 66 in the present embodiment is retractable from an emission position (the position in FIG. 9) at which ultraviolet light is emitted toward a sheet during foil stamping to a retracted position (the position in FIG. 10) that is above the emission position and that is farther than the emission position from the carrying surface.

The controller 20 controls the electric cylinder 78 and the two stepping motors 84 to adjust the size of the gap G to be a target size. Specifically, when the gap G is to be reduced, the controller 20 controls the two stepping motors 84 to lower the two stoppers 82 to positions in the up-down direction corresponding to a target size of the gap G and next controls the electric cylinder 78 to lower the nip roller support 80 so as to come into contact with the stoppers 82.

In addition, when the gap G is to be increased, the controller 20 controls the electric cylinder 78 to raise the nip rollers 62 and 64 to positions at which the size of the gap G is increased to be larger than a target size, next controls the two stepping motors 84 to raise the two stoppers 82 to positions in the up-down direction corresponding to the target size of the gap G, and next controls the electric cylinder 78 to lower the nip roller support 80 so as to come into contact with the stoppers 82. Note that, although the nip roller support 80 can be pushed up by raising the two stoppers 82 by the two stepping motors 84, it is preferable not to apply a load of pushing up the nip roller support 80 to the stepping motors 84 in consideration of durability.

The above is a detailed configuration of the foil stamper 16. Next, an operation of the foil stamper 16 will be described.

FIGS. 11A to 11F chronologically illustrate an operation of the foil stamper 16 when foil stamping is performed (first mode).

Figure 11A:
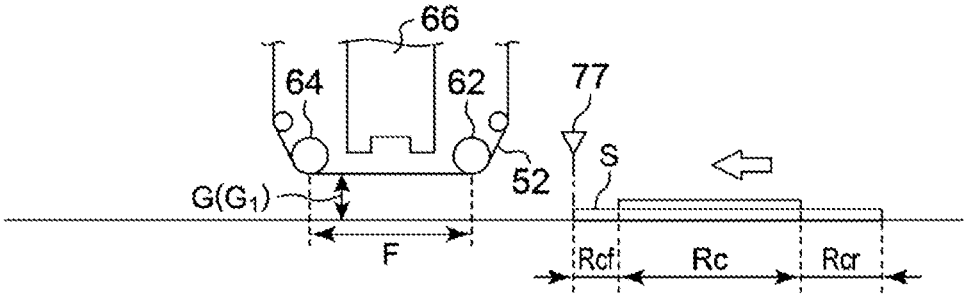
FIGS. 11A to 11F chronologically illustrate an operation of a foil stamper when foil stamping is performed.

FIG. 11A illustrates a state of waiting the sheet S reaching a foil stamping section. In FIG. 11A, the leading end of the sheet S has reached the sheet detection sensor 77. In FIG. 11A, braking has been performed by the brake mechanisms 68 and 70.

Varnish has been applied to the sheet S and semi-cured. The sheet S has a leading-end non-processing range Rcf, a processing range Rc, and a tail-end non-processing range Rcr. The leading-end non-processing range Rcf, the processing range Rc, and the tail-end non-processing range Rcr are arranged in this order from the leading end side of the sheet S. Varnish has not been applied to the leading-end non-processing range Rcf and the tail-end non-processing range Rcr. The leading-end non-processing range Rcf is a range from the leading end of the sheet S to the leading end of the processing range Rc. The tail-end non-processing range Rcr is a range from the tail end of the processing range Rc to the tail end of the sheet S. The processing range Rc is a range that includes a region to which varnish has been applied. When there is one region to which varnish has been applied, the processing range Rc is a range from the leading end to the tail end of the one region in the carrying direction Y. When there are a plurality of regions to which varnish has been applied, the processing range Rc is a range from the leading end of, among the plurality of regions, a region whose leading end is positioned on the most downstream side to the tail end of, among the plurality of regions, a region whose tail end is positioned on the most upstream side.

In FIG. 11A, the size of the gap G is adjusted to a first size $G_1$ (for example, 3 mm). The first size is a size that does not allow contact of the web 52 with the sheet S even if the sheet S is present in the gap G.

Figure 11B:
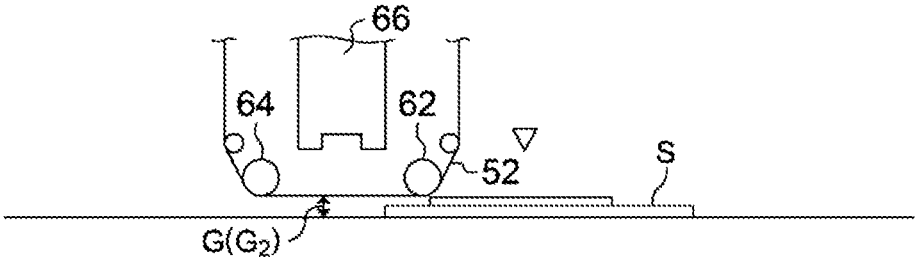

FIG. 11B illustrates a state immediately before the leading end of the processing range Rc of the sheet S enters the foil stamping section F. In FIG. 11B, the size of the gap G is adjusted to a second size $G_2$ (<the first size $G_1$). The second size $G_2$ is a size of the gap G corresponding to the thickness of the sheet S. The second size $G_2$ is a size that allows the sheet S to enter the gap G and that is a size that causes the web 52 to come into contact with the sheet S with an appropriate contact pressure and that can achieve satisfactory foil stamping. For example, a size of the gap corresponding to the thickness of the sheet S may be inputted by a user, and the controller 20 may obtain the size as the second size $G_2$, or the controller 20 may calculate the second size $G_2$ on the basis of the thickness of the sheet S inputted by a user. Alternatively, the controller 20 may previously store correlation information in which various sheet thicknesses are associated with suitable sizes of the gap G corresponding to each of the various sheet thicknesses. Then, for example, a sensor that obtains a thickness of a sheet may be provided at an appropriate position to obtain the thickness of a sheet. Then, the second size $G_2$, which is a size of the gap G corresponding to a thickness of a sheet, may be specified on the basis of the obtained thickness of the sheet and the correlation information. The size of the gap G corresponding to the thickness of the sheet may be the thickness of the sheet excluding varnish.

Timing of adjusting the size of the gap G from the first size $G_1$ to the second size $G_2$, in other words, timing of lowering the nip rollers 62 and 64 is set to timing when a pulse P1 is counted after pulses are obtained by an encoder interposed at a drive mechanism of the carrying rollers 54 and the leading end of the sheet S is detected by the sheet detection sensor 77. The pulse P1 is determined on the basis of a length, which is obtained from the varnish data, of the leading-end non-processing range Rcf in the carrying direction. The pulse P1 may be slightly adjustable in accordance with a finishing state by an input by a user. Note that the size of the gap G may be adjusted to become the second size $G_2$ immediately before the leading end of the sheet S enters the foil stamping section F. In this case, however, the web 52 is fed unnecessarily, and the web 52 is wasted. Therefore, preferably, the size of the gap G is adjusted to become the second size $G_2$ immediately before the leading end of the processing range Rc enters the foil stamping section F.

When changing of the gap G from the first size $G_1$ to the second size $G_2$ is to be started, in other words, when lowering of the nip rollers 62 and 64 is to be started, braking by the first brake mechanism 68 is cancelled. Braking by the second brake mechanism 70 may be cancelled substantially at the same time with cancelling of braking by the first brake mechanism 68. However, preferably, braking by the second brake mechanism 70 is cancelled after a certain time has elapsed since cancellation of braking by the first brake mechanism 68. Timing of cancelling braking by the second brake mechanism 70 may be, for example, a moment of transition to the state in FIG. 11B. When the sheet in the state in FIG. 11B enters the foil stamping section F with sagging remaining in the foil, a displacement between the foil and the sheet in the carrying direction may occur and cause a transfer failure at a leading end portion of the processing range Rc. Since a braking force of the second brake mechanism 70 acts at a moment when the nip rollers 62 and 64 are lowered and stopped, generation of sagging due to an impact of the stoppage of the nip rollers 62 and 64 is suppressed. Due to timing of cancelling braking by the first brake mechanism 68 and timing of cancelling braking by the second brake mechanism 70 differing from each other, it is possible to apply an appropriate tension to the foil when the leading end of the processing range Rc enters the foil stamping section F and prevent a transfer failure at the leading end portion of the processing range Rc. Since braking by the first brake mechanism 68 is first cancelled and thereafter braking by the second brake mechanism 70 is cancelled, it is possible to prevent the foil from being fed in an opposite direction when the nip rollers 62 and 64 are lowered.

When the sheet S further moves and enters the foil stamping section F, the sheet S is bonded to the web 52 due to the tackiness of the semi-cured-state varnish, and the web 52 also moves together with the sheet S that is moved by the carrying rollers 54.

Meanwhile, when the gap G has the second size $G_2$, the controller 20 controls the electric cylinder 78 to press the nip roller support 80 against the stoppers 82, in other words, downward. Specifically, the controller 20 considers that a position at which the gap G is zero is a target position and controls the electric cylinder 78 to continuously move the nip roller support 80 and eventually the nip rollers 62 and 64. Consequently, the nip roller support 80 is pressed toward the stoppers 82, and the nip rollers 62 and 64 are pressed downward. Consequently, even when the sheet S is in the foil stamping section F, the nip rollers 62 and 64 do not escape upward, the size of the gap G is maintained to be the second size $G_2$, the web 52 and the sheet S are in contact with each other with an appropriate contact pressure, and the web 52 can be bonded to the sheet firmly.

Figure 11C:
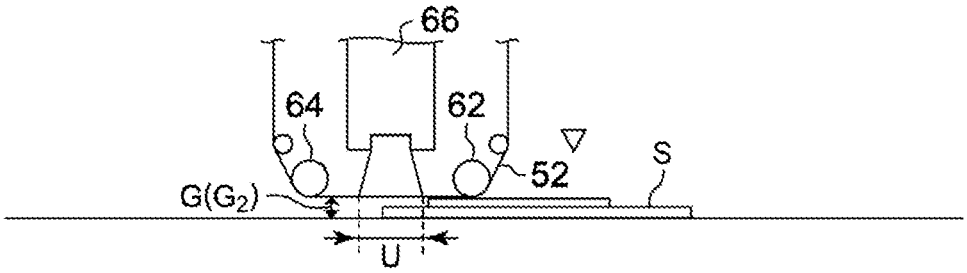

FIG. 11C illustrates a state immediately before the leading end of the processing range Rc enters an emission range U of the ultraviolet light of the foil-stamping ultraviolet lamp 66. At this timing, the foil-stamping ultraviolet lamp 66 starts lighting. The timing of starting lighting is set to timing when a pulse P2 is counted after the sheet detection sensor 77 detects the leading end of the sheet S. The pulse P2 is determined on the basis of a length, which is obtained from the varnish data, of the leading-end non-processing range Rcf in the carrying direction.

Figure 11D:
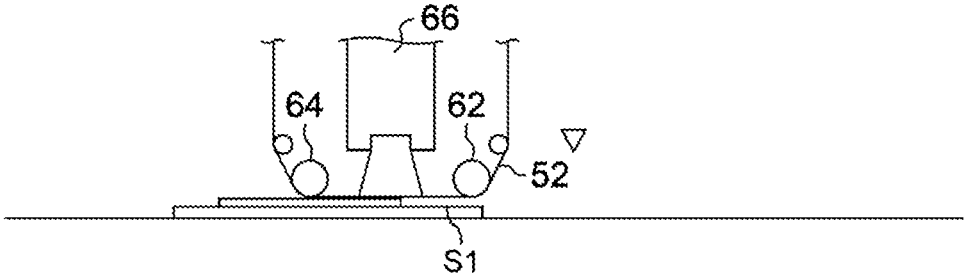

In FIG. 11D, the sheet S moves in a state of being in contact with the web 52. At this time, ultraviolet light is emitted from the foil-stamping ultraviolet lamp 66 to the semi-cured-state varnish on the sheet S. The varnish is completely cured by this emission. The foil of the web 52 and the sheet S are bonded to each other strongly by the completely cured varnish. In FIG. 11D, the web 52 has already been separated from a portion of the processing range Rc near the leading end. However, the foil that has been bonded by the completely cured varnish remains in a region on the sheet S where the varnish has been applied.

Figure 11E:
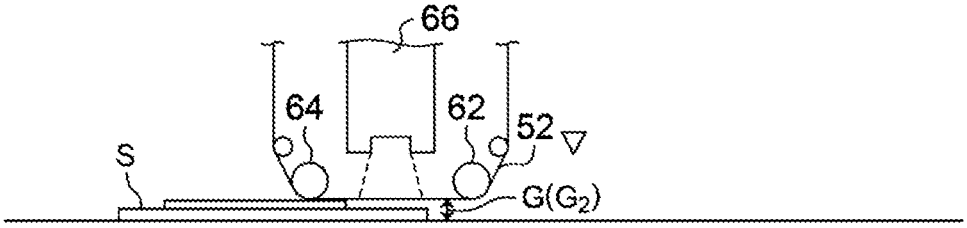

FIG. 11E illustrates a state immediately after the tail end of the processing range Rc exits the emission range U of the foil-stamping ultraviolet lamp 66. At this timing, the foil-stamping ultraviolet lamp 66 stops lighting. The timing of stopping lighting is set to timing when a pulse P3 is counted after the sheet detection sensor 77 detects the leading end of the sheet S. The pulse P3 is determined on the basis of lengths, which are obtained from the varnish data, of the leading-end non-processing range Rcf and the processing range Rc in the carrying direction.

Figure 11F:
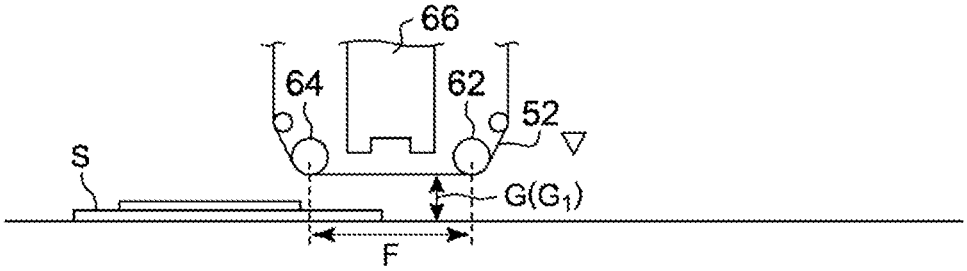

FIG. 11F illustrates a state immediately after the tail end of the processing range Rc exits the foil stamping section F. In FIG. 11F, braking has been performed by the brake mechanisms 68 and 70. The size of the gap G has been returned to the first size $G_1$. The timing of returning the size of the gap G from the second size $G_2$ to the first size $G_1$, in other words, timing of raising the nip rollers 62 and 64 is set to timing when a pulse P4 is counted after the sheet detection sensor 77 detects the leading end of the sheet S. The pulse P4 is determined on the basis of lengths, which are obtained from the varnish data, of the leading-end non-processing range Rcf and the processing range Rc in the carrying direction. Since the sheet S and the web 52 are separated from each other, the movement of the web 52 together with the movement of the sheet S stops. Note that the size of the gap G may be adjusted to become the first size $G_1$ immediately after the tail end of the sheet S exits the foil stamping section F. In this case, however, the web 52 is fed unnecessarily, and the web 52 is wasted. Therefore, preferably, the size of the gap G is adjusted to become the first size $G_1$ immediately after the tail end of the processing range Rc exits the foil stamping section F.

The sheet S on which foil stamping has been performed is discharged onto the stacker 18 (refer to FIG. 1 and FIG. 2), and foil stamping processing of the sheet S is completed.

The operation in FIGS. 11A to 11F is repeated until processing of the number of sheets specified in the job data is completed.

Figure 12A:
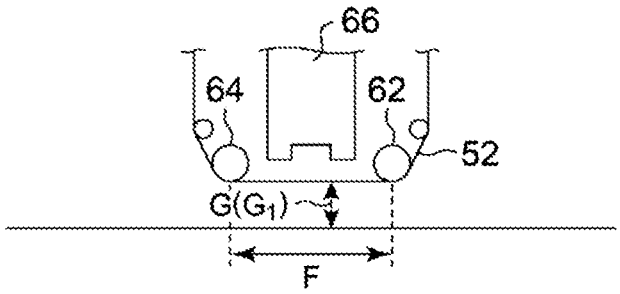
FIGS. 12A to 12C chronologically illustrate an operation of a foil stamper when web mounting-replacing work is performed.
Figure 12B:
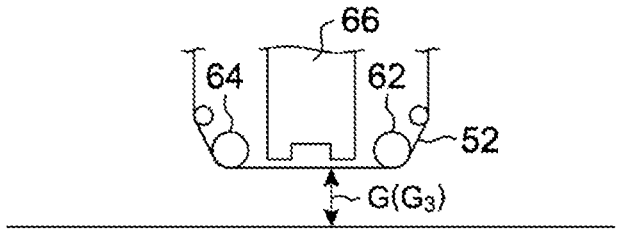
Figure 12C:
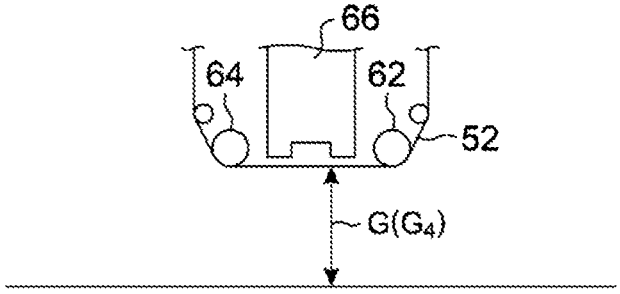

FIGS. 12A to 12C chronologically illustrate an operation of the foil stamper 16 when web mounting-replacing work is performed. In FIG. 12A, the size of the gap G has been adjusted to the first size $G_1$. The gap G is increased from the state in FIG. 12A by raising the nip roller support 80 (not illustrated in FIG. 12A to 12C) and eventually the nip rollers 62 and 64.

In FIG. 12B, the size of the gap G has been adjusted to a third size $G_3$ (>the first size $G_1$). At this time, although not illustrated in each of FIG. 12A to 12C, the nip roller support 80 comes into contact with the rubber leg 108 of the foil-stamping ultraviolet lamp 66.

When the nip roller support 80 is further raised, the foil-stamping ultraviolet lamp 66 is also raised as illustrated in FIG. 12C. In other words, when the size of the gap G is increased to be larger than the third size $G_3$, the foil-stamping ultraviolet lamp 66 is raised together with the nip rollers 62 and 64. In other words, the foil-stamping ultraviolet lamp 66 is raised together with the web route in the foil stamping section F. FIG. 12C illustrates a state in which the nip roller support 80 and the foil-stamping ultraviolet lamp 66 are each raised to the uppermost position and in which the size of the gap G is a fourth size $G_4$ (>the third size $G_3$). In the state in FIG. 12C, the web mounting-replacing work including leading of the web 52 is performed.

When the web mounting-replacing work is completed, the state is returned to the state in FIG. 12A. In other words, the size of the gap G is returned to the first size $G_1$. At this time, until when the size of the gap G becomes the third size $G_3$, the foil-stamping ultraviolet lamp 66 is lowered together with the nip rollers 62 and 64, in other words, the web route in the foil stamping section F. When the size of the gap G becomes the third size $G_3$, the foil-stamping ultraviolet lamp 66 is supported by the lamp stopper 104 and is not allowed to be lowered further.

According to the present embodiment, the size of the gap G between the web route and the carrying surface in the foil stamping section F is adjusted to be a gap corresponding to the thickness of a sheet. Consequently, it is possible to cause the web 52 and the sheet to come into contact with each other with an appropriate contact pressure and possible to achieve satisfactory foil stamping.

In addition, according to the present embodiment, even when the nip rollers 62 and 64 are pressed downward during foil stamping and a sheet is consequently in the gap G, the nip rollers 62 and 64 do not escape upward and the size of the gap G is maintained to be the second size $G_2$. Therefore, the web 52 and the sheet S come into contact with each other with an appropriate contact pressure, and the web 52 can be bonded to the sheet firmly.

In addition, according to the present embodiment, web mounting-replacing work can be easily performed since the nip rollers 62 and 64, in other words, the web route in the foil stamping section F and the foil-stamping ultraviolet lamp 66 can be retracted upward.

In addition, according to the present embodiment, the foil-stamping ultraviolet lamp 66 can be moved upward and downward by the gap adjustment mechanism 72 that adjusts the size of the gap G by moving the nip rollers 62 and 64 upward and downward. Consequently, it is possible to reduce the number of driving sources and reduce costs of the foil stamper 16, compared with the other cases.

The present invention has been described above on the basis of an embodiment. It should be understood by a person skilled in the art that this embodiment is presented as an example, that various modifications of combinations of those components and processing processes are available, and that such modifications are also within the scope of the present invention. Hereinafter, such modifications will be described.

While the web 52 in the present embodiment moves by coming into contact with the sheet S that moves, when a drive for moving the web 52 is separately provided, the foil-stamping ultraviolet lamp 66 may be caused, in accordance with timing of turning on/off of the drive, to stop lighting during a period in which the web 52 is stopped.

In addition, while an example in which one processing range Rc is formed on the sheet S has been described in the present embodiment, when regions to which varnish is to be applied are largely separated from each other on the leading end side and the tail end side of the sheet S, respectively, the regions may be considered as different processing ranges Rc, and a plurality of the processing ranges Rc may be set with respect to one sheet. Then, starting/stopping of lighting of the foil-stamping ultraviolet lamp 66 may be controlled for each of the processing ranges Rc. Specifically, control in which the foil-stamping ultraviolet lamp 66 is caused to start lighting immediately before the leading end of the processing range Rc reaches the emission range U and caused to stop lighting immediately after the tail end of the processing range Rc exits the emission range U may be individually performed for each of the plurality of processing ranges Rc. Consequently, it is possible to shorten the time of emitting the ultraviolet light to the sheet S and possible to suppress inconvenience such as deformation of the sheet S due to the heat of the ultraviolet light.

Further, when the processing range Rc that is present on the leading end side and the processing range Rc that is present on the tail end side thereof are adjacent to each other in the carrying direction and when a gap between the tail end of the processing range Rc on the leading end side and the leading end of the processing range Rc on the tail end side is longer than the length of the foil stamping section F in the carrying direction, the size of the gap G may be set to the first gap immediately after the tail end of the processing range Rc on the leading end side exits the foil stamping section F until immediately before the leading end of the processing range Rc on the tail end side enters the foil stamping section F. Since the web 52 is not fed and is stopped while the first nip roller 62 and the second nip roller 64 are present in the first gap, it is preferable to cause the foil-stamping ultraviolet lamp 66 to stop lighting after the tail end of the processing range Rc on the leading end side exits the emission range U until the first nip roller 62 and the second nip roller 64 are raised and thereafter cause the foil-stamping ultraviolet lamp 66 to perform lighting again after the first nip roller 62 and the second nip roller 64 are lowered until the leading end of the processing range Rc on the tail end side enters the emission range U. Consequently, it is possible to suppress the fed length of the web 52 and to eventually achieve saving of the foil.

In addition, the complete-curing ultraviolet lamp may be caused to stop lighting immediately when the web 52 is stopped in an emergency stoppage or an abnormal stoppage of the apparatus due to jamming or the like.

In addition, even when ultraviolet light of the foil-stamping ultraviolet lamp 66 is emitted to the web 52 that has been stopped, the web 52 can withstand if the time of the emission is just a short time. Therefore, the foil-stamping ultraviolet lamp 66 may be caused to perform lighting or stop lighting at timing at which the emission time during a stoppage does not exceed a predetermined time.

In addition, although not mentioned in particular in the embodiment, the height positions of the two stoppers 82 may be adjusted individually. For example, the height positions of the two stoppers 82 may be slightly adjusted individually while a result of moving the two stoppers 82 to positions in the up-down direction corresponding to the thickness of a sheet is viewed.

Further, the position of the sheet in the width direction X is aligned at the aligning reference guide 32, and a side (the right side in the width direction in FIG. 2) where the aligning reference guide 32 is provided is used as a reference to carry the sheet. Therefore, since the sheet is allowed to pass on one side in the width direction while the sheet is not allowed to pass on the other side in the width direction when the dimension of the sheet in the width direction is small, unevenness in the width direction may be generated in the contact pressure between the web 52 and the sheet. Thus, the dimension of the sheet in the width direction may be input by a user or obtained by an appropriate sensor, and the height positions of the two stoppers 82 may be adjusted on the basis of the dimension of the sheet in the width direction. For example, the controller 20 may raise the height position of the stopper 82 on one side in the width direction to be higher than the height position of the stopper 82 on the other side in the width direction to increase a gap, through which the sheet passes, on the one side in the width direction to be larger than a gap on the other side in the width direction. In addition, for example, when the dimension of the sheet in the width direction is less than or equal to a predetermined dimension, the controller 20 may increase the gap on one side in the width direction to be larger than the gap on the other side in the width direction.

Meanwhile, the technical concept of the embodiment is not limited to be applied to transferring of foil to a sheet. In other words, a transfer target object to which foil is to be transferred by the foil stamper 16 may be objects other than sheets.

In addition, a transfer layer of the web 52 that holds foil is normally formed by vapor depositing, applying, or pasting a metal, a color material, or the like to a base film, and the transfer layer serves as the "foil", which is a transfer substance. In addition, a separation layer, an adhesive layer, and the like may be added to cause the transfer layer to exert more excellent adhesiveness during transferring and excellent separability from the base film. In addition, a long base sheet that holds a transfer substance is not limited to a film and may be any member, such as woven fabric having a belt shape, as long as the member can hold the transfer substance and the transfer substance can be transferred to a transfer target object in a transfer section. Meanwhile, the transfer substance that is to be held by the web 52 and to be transferred in a transfer section, such as the foil stamping section F, is not limited to "foil" and may be a thin layer made of a material other than metals. Alternatively, a member in which, like an ink ribbon, a transfer substance such as an ink is applied to a web that is a base may be employed. In addition, a long base sheet that holds a transfer substance is not limited to a film and may be any member, such as woven fabric having a belt shape, as long as the member can hold the transfer substance and the transfer substance can be transferred to a transfer target object in a transfer section.

In addition, the transfer apparatus is not limited to a transfer apparatus that transfers a transfer substance held by the web 52 and may be a transfer apparatus that performs processing that is so-called "lamination coating processing", in which a web having a surface on which fine irregularities are formed and varnish that has been applied to a surface of a transfer target object are brought into close contact with each other, the irregularity shape is transferred to a varnish surface, and a surface shape that is formed by the fine irregularities of the web is thereby transferred to the transfer target object. Also in the lamination coating processing, when the gap G is too large with respect to the thickness of the transfer target object, the contact pressure between the web and the varnish is too low and causes insufficient transferring of the surface shape or causes the surface shape not to be transferred at all. When the gap G is too small with respect to the thickness of the transfer target object, the transfer target object is not allowed to enter the gap G or, even when allowed to enter the gap G, causes the varnish to spread and deforms the shape of the varnish. According to the present invention, it is possible to obtain a transfer apparatus that does not cause these inconveniences and that can transfer a surface shape appropriately.

Further, according to the present invention, it is possible to reliably transfer the surface shape of the web 52 to the varnish on the transfer target object since the electric cylinder 78 does not allow the nip rollers 62 and 64 to escape upward even during transferring and maintains a predetermined gap G.

Any combinations of the embodiment and the modifications described above are also useful as embodiments of the present invention. New embodiments generated by combinations have respective effects of the embodiment and the modifications that are combined together. In addition, it should also be understood by a person skilled in the art that functions that should be exerted by the components described in the claims are achieved solely or cooperatively by the components presented in the embodiment and the modifications.

REFERENCE SIGNS LIST

10 print system
16 foil stamper
52 web
60 guide roller
62 first nip roller
64 second nip roller
72 gap adjustment mechanism
F foil stamping section
G gap
S sheet

The invention claimed is:

1. A transfer apparatus that transfers, in a transfer section, a transfer substance or a surface shape of a transfer web from the transfer web, the transfer web being carried along a web route, to a transfer target object that is carried along a carrying surface, the transfer apparatus comprising:

a gap adjustment mechanism that adjusts a size of a gap between the carrying surface and the web route in the transfer section; and a controller that controls the gap adjustment mechanism to adjust the size of the gap to be a size corresponding to a thickness of the transfer target object, wherein the gap adjustment mechanism is able to adjust the gap at two locations in a width direction individually.

2. The transfer apparatus according to claim 1, wherein the controller controls the gap adjustment mechanism to maintain the gap to have the size corresponding to the thickness of the transfer target object even when the transfer target object is in the gap.

3. The transfer apparatus according to claim 2, comprising:

a roller that defines the web route in the transfer section, wherein the gap adjustment mechanism includes a stopper that restricts a movement of the roller toward the carrying surface and thereby positions the roller at a position corresponding to the thickness of the transfer target object, and a presser that presses against the stopper a support that supports the roller.

4. The transfer apparatus according to claim 1, comprising:

an aligning reference guide provided on one end side in the width direction and with which the transfer target object carried toward the transfer section is to be brought into contact to position a position of the transfer target object in the width direction, wherein, when a dimension of the transfer target object in the width direction is less than or equal to a predetermined dimension, the controller controls the gap adjustment mechanism to cause one end side of the gap in the width direction to be larger than another end side of the gap.

5. A transfer apparatus that transfers, in a transfer section, a transfer substance or a surface shape of a transfer web from the transfer web, the transfer web being carried along a web route, to a transfer target object that is carried along a carrying surface, the transfer apparatus comprising:

a gap adjustment mechanism that adjusts a size of a gap between the carrying surface and the web route in the transfer section;

a controller that controls the gap adjustment mechanism to adjust the size of the gap to be a size corresponding to a thickness of the transfer target object, and an ultraviolet light source unit that emits ultraviolet light in the transfer section from an emission position on a side opposite to the carrying surface with respect to the web route, wherein the ultraviolet light source unit is retractable from the emission position to a retracted position that is farther away from the carrying surface than the emission position.

6. The transfer apparatus according to claim 5, wherein the ultraviolet light source unit is movable between the emission position and the retracted position by the gap adjustment mechanism.

7. The transfer apparatus according to claim 6, wherein the gap adjustment mechanism raises and lowers the web route in the transfer section and thereby adjusts the size of the gap, wherein, when the size of the gap is less than or equal to a threshold value, the ultraviolet light source unit is not supported by the gap adjustment mechanism and is kept at the emission position regardless of raising and lowering of the web route, and wherein, when the size of the gap is more than the threshold value, the ultraviolet light source unit is supported by the gap adjustment mechanism and is raised and lowered together with the web route.

8. A transfer apparatus that transfers, in a transfer section, a transfer substance or a surface shape of a transfer web from the transfer web, the transfer web being carried along a web route, to a transfer target object that is carried along a carrying surface, the transfer apparatus comprising:

a gap adjustment mechanism that adjusts a size of a gap between the carrying surface and the web route in the transfer section;

a controller that controls the gap adjustment mechanism to adjust the size of the gap to be a size corresponding to a thickness of the transfer target object, and a sensor that is able to detect an arrival of the transfer target object carried toward the transfer section, wherein the controller controls the gap adjustment mechanism to adjust the gap to be larger than the gap corresponding to the thickness of the transfer target object until the sensor detects the arrival of the transfer target object, and adjust the gap, when the sensor detects the arrival of the transfer target object, to be the gap corresponding to a thickness of the transfer target object.

9. A transfer apparatus that transfers, in a transfer section, a transfer substance or a surface shape of a transfer web from the transfer web, the transfer web being carried along a web route, to a transfer target object that is carried along a carrying surface, the transfer apparatus comprising:

a gap adjustment mechanism that adjusts a size of a gap between the carrying surface and the web route in the transfer section;

a controller that controls the gap adjustment mechanism to adjust the size of the gap to be a size corresponding to a thickness of the transfer target object, and first and second rollers that define the web route in the transfer section, wherein the first roller is disposed to have an axial direction that coincides with the width direction, wherein the second roller is disposed to have an axial direction that coincides with the width direction and such that the web route in the transfer section defined between the first roller and the second roller is opposite to the carrying surface, and wherein the gap adjustment mechanism adjusts positions of the first and second rollers in an up-down direction and thereby adjusts the size of the gap.

10. A transfer apparatus comprising:

a web carrying mechanism that carries a transfer web along a web route;

a transfer-target-object carrying mechanism that carries a transfer target object;

an ultraviolet light source unit that emits ultraviolet light from an emission position on a side opposite to a carrying surface of the transfer-target-object carrying mechanism with respect to the web route in a transfer section in which a transfer substance of the transfer web or a surface shape of the transfer web is transferred to the transfer target object; and a gap adjustment mechanism that raises and lowers the web route in the transfer section and thereby adjusts a gap between the web route and the carrying surface in the transfer section, wherein the ultraviolet light source unit is raised and lowered together with the web route when a size of the gap is more than a threshold value.

11. The transfer apparatus according to claim 10, wherein the gap adjustment mechanism is able to adjust the gap at two locations in a width direction individually.

12. The transfer apparatus according to claim 11, comprising:

an aligning reference guide provided on one end side in the width direction and with which the transfer target object carried toward the transfer section is to be brought into contact to position a position of the transfer target object in the width direction, wherein, when a dimension of the transfer target object in the width direction is less than or equal to a predetermined dimension, the controller controls the gap adjustment mechanism to cause one end side of the gap in the width direction to be larger than another end side of the gap.

13. The transfer apparatus according to claim 10, wherein the gap adjustment mechanism raises and lowers the web route in the transfer section and thereby adjusts the size of the gap, wherein, when the size of the gap is less than or equal to a threshold value, the ultraviolet light source unit is not supported by the gap adjustment mechanism and is kept at the emission position regardless of raising and lowering of the web route, and wherein, when the size of the gap is more than the threshold value, the ultraviolet light source unit is supported by the gap adjustment mechanism and is raised and lowered together with the web route.

14. The transfer apparatus according to claim 10, further comprising: a sensor that is able to detect an arrival of the transfer target object carried toward the transfer section, wherein the controller controls the gap adjustment mechanism to adjust the gap to be larger than the gap corresponding to the thickness of the transfer target object until the sensor detects the arrival of the transfer target object, and adjust the gap, when the sensor detects the arrival of the transfer target object, to be the gap corresponding to a thickness of the transfer target object.

15. The transfer apparatus according to claim 10, further comprising: first and second rollers that define the web route in the transfer section, wherein the first roller is disposed to have an axial direction that coincides with the width direction, wherein the second roller is disposed to have an axial direction that coincides with the width direction and such that the web route in the transfer section defined between the first roller and the second roller is opposite to the carrying surface, and wherein the gap adjustment mechanism adjusts positions of the first and second rollers in an up-down direction and thereby adjusts the size of the gap.

16. The transfer apparatus according to claim 8, wherein the gap adjustment mechanism is able to adjust the gap at two locations in a width direction individually.

17. The transfer apparatus according to claim 16, comprising:

an aligning reference guide provided on one end side in the width direction and with which the transfer target object carried toward the transfer section is to be brought into contact to position a position of the transfer target object in the width direction, wherein, when a dimension of the transfer target object in the width direction is less than or equal to a predetermined dimension, the controller controls the gap adjustment mechanism to cause one end side of the gap in the width direction to be larger than another end side of the gap.

18. The transfer apparatus according to claim 10, wherein the gap adjustment mechanism is able to adjust the gap at two locations in a width direction individually.

19. The transfer apparatus according to claim 18, comprising:

an aligning reference guide provided on one end side in the width direction and with which the transfer target object carried toward the transfer section is to be brought into contact to position a position of the transfer target object in the width direction, wherein, when a dimension of the transfer target object in the width direction is less than or equal to a predetermined dimension, the controller controls the gap adjustment mechanism to cause one end side of the gap in the width direction to be larger than another end side of the gap.

* * * * *